US006130998A

United States Patent [19]

Ochiai

[11] Patent Number: 6,130,998

[45] Date of Patent: Oct. 10, 2000

[54] PHOTOSENSITIVE MATERIAL PROCESSING APPARATUS

[75] Inventor: Kanenori Ochiai, Kanagawa, Japan

[73] Assignee: Fuji Photo Film Co., Ltd., Kanagawa, Japan

[21] Appl. No.: 09/102,671

[22] Filed: Jun. 23, 1998

[30] Foreign Application Priority Data

Aug. 22, 1997 [JP] Japan ..... 9-225980

[51] Int. Cl.[7] ..... G03D 3/08; B65H 5/00; B65H 29/00

[52] U.S. Cl. ..... 396/612; 271/184; 271/225

[58] Field of Search ..... 396/612, 564; 355/27–29; 271/64, 225, 184–186

[56] References Cited

U.S. PATENT DOCUMENTS 4,657,238 4/1987 Nishikawa ..... 271/186
4,864,355 9/1989 Knecht et al. ..... 355/27
5,090,680 2/1992 Yashiro ..... 271/186
5,678,111 10/1997 Matsumoto ..... 396/612

*Primary Examiner*—D. Rutledge
*Attorney, Agent, or Firm*—Sughrue, Mion, Zinn, Macpeak & Seas, PLLC

[57] ABSTRACT

A photographic printing paper, which is discharged from a discharge opening of a processor section with an image forming surface facing downward, is conveyed upward by conveying rollers, and along the way, the image forming surface is oriented upward. Thereafter, the photographic printing paper whose image forming surface has been oriented upward is stacked in a tray of a sorter with the image forming surface facing upward.

6 Claims, 22 Drawing Sheets

PHOTOSENSITIVE MATERIAL PROCESSING APPARATUS

BACKGROUND OF THE INVENTION

1. Field of the Invention

The present invention relates to a photosensitive material processing apparatus having an accommodating portion in which photosensitive materials which have been subjected to developing processing are stacked.

2. Description of the Related Art

A photosensitive material stacking device, in which photographic printing papers (photosensitive materials) which have been discharged from the discharge opening of a processing section are stacked per order, is provided at a photosensitive material processing apparatus known as a printer processor.

There are photosensitive material stacking devices which are provided with trays (accommodating portions) in which photographic printing papers are stacked substantially horizontally.

There are types of photosensitive material processing apparatuses in which, due to the internal structure of the printer processor, the processed photographic printing papers are discharged from the discharge opening with the image forming surfaces thereof facing downward, and are stacked in the tray in that state.

Further, there are photosensitive material processing apparatuses in which, due to the internal structure of the printer processor, even if the photographic printing papers are discharged from the discharge opening with the image forming surfaces thereof facing upward, thereafter, the fronts and backs of the photographic printing papers are reversed by the time the photographic printing papers are conveyed to the tray such that the photographic printing papers are stacked in the tray with their image forming surfaces facing downward.

However, in both of the above-described types of photosensitive material stacking devices, there is the drawback that time and labor are required to confirm the images because the photographic printing papers are stacked in the tray with the image forming surfaces thereof facing downward.

Further, when the photographic printing papers are discharged with the image forming surfaces thereof facing upward, the drying device and the stacking device are disposed downstream of the processing device, and the printer processor occupies a large surface area (a large floor space).

SUMMARY OF THE INVENTION

In view of the aforementioned, an object of the present invention is to provide a photosensitive material processing apparatus in which photosensitive materials can be stacked in an accommodating portion with the image forming surfaces thereof facing upward.

A first aspect of the present invention is a photosensitive material processing apparatus in which an exposed photosensitive material is conveyed into a developing section with an image forming surface of the photosensitive material facing upward and is discharged from a discharge opening with the image forming surface facing downward, comprising: an accommodating portion in which the photosensitive material discharged from the discharge opening is stacked; and conveying means, provided between the discharge opening and the accommodating portion, for reversing the front and back of the photosensitive material discharged from the discharge opening, and stacking the photosensitive material in the accommodating portion.

In the photosensitive material processing apparatus of the first aspect, the front and back of a photosensitive material, which is discharged from the discharge opening with the image forming surface facing downward, are reversed by the conveying device, and the photosensitive material is discharged to the accommodating portion with the image forming surface facing upward. Because the photosensitive materials are stacked in the accommodating portion with the image forming surfaces thereof facing upward, confirmation of the images is facilitated.

Herein, the "front" of the photosensitive material or photographic printing paper refers to the image forming surface thereof, whereas the "back" refers to the surface opposite the image forming surface, i.e., the surface on which images are not formed.

A second aspect of the present invention is a photosensitive material processing apparatus in which an exposed photosensitive material is conveyed into a developing section with an image forming surface of the photosensitive material facing upward and is discharged from a discharge opening with the image forming surface facing upward, comprising: an accommodating portion in which the photosensitive material discharged from the discharge opening is stacked; and conveying means, provided between the discharge opening and the accommodating portion, for stacking the photosensitive material, which has been discharged from the discharge opening, in the accommodating portion with the image forming surface facing upward.

In the photosensitive material processing apparatus of the second aspect, a photosensitive material, which is discharged from the discharge opening with the image forming surface facing upward, is discharged to the accommodating portion by the conveying device with the image forming surface facing upward. Because the photosensitive materials are stacked in the accommodating portion with the image forming surfaces thereof facing upward, confirmation of the images is facilitated.

DESCRIPTION OF THE PREFERRED EMBODIMENTS

First Embodiment

A first embodiment of the present invention will be described hereinafter with reference to FIGS. 1 through 3.

Figure 1:
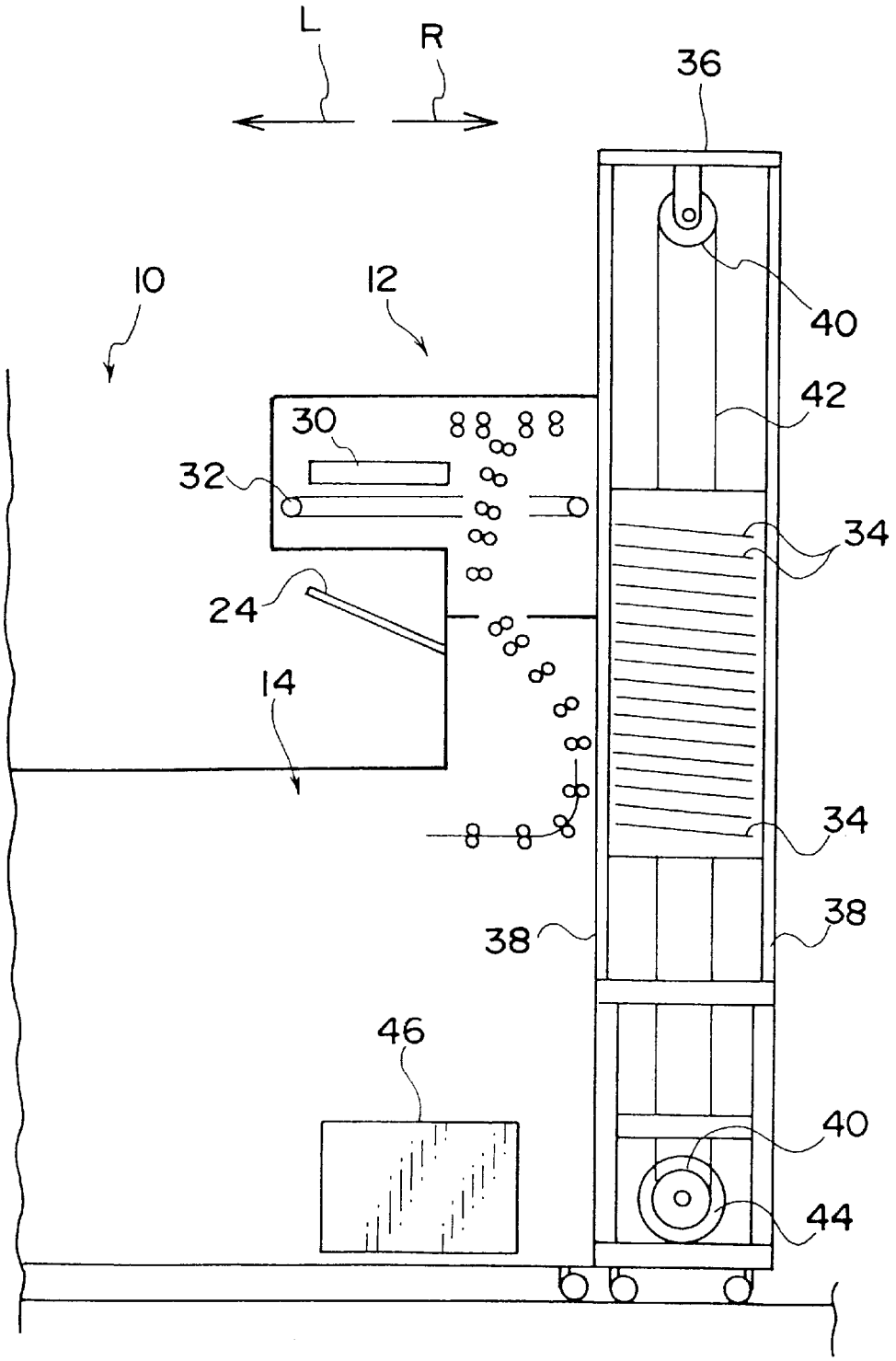
FIG. 1 is a cross-sectional view, as viewed from the front, of main portions of a photosensitive material processing apparatus relating to a first embodiment of the present invention.

FIG. 1 illustrates a stacking device 12 which is provided in a printer processor 10 which serves as a photosensitive material processing apparatus relating to the first embodiment of the present invention.

The printer processor 10 has a known structure including a printer section (not illustrated), which prints images of negative films onto photographic printing papers, and a processor section 14, which carries out developing processing, fixing processing, washing and drying of the photographic printing papers.

Figure 2:
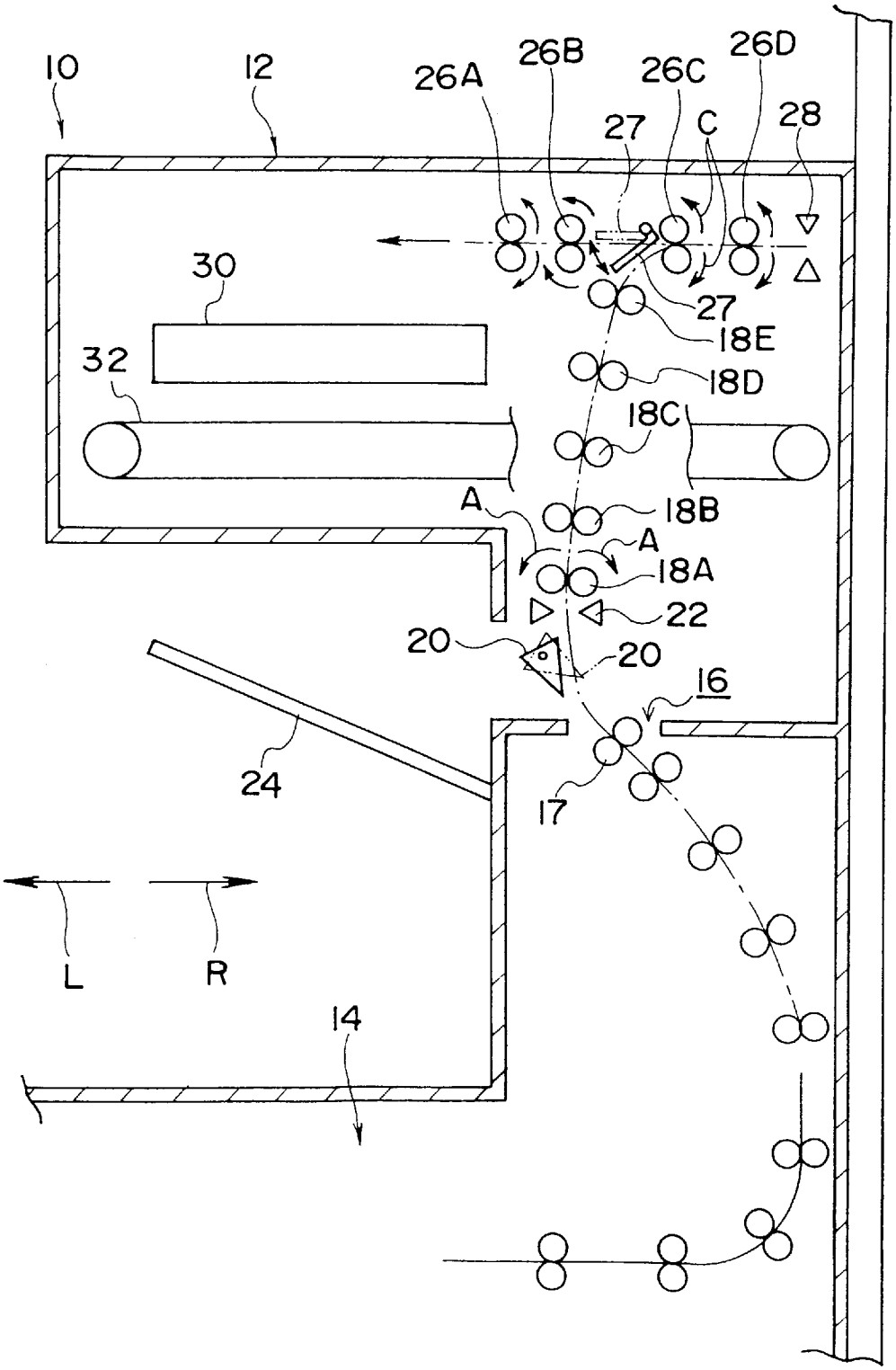
FIG. 2 is an enlarged view of the main portions of the photosensitive material processing apparatus illustrated in FIG. 1.

As shown in FIG. 2, in the present embodiment, a photographic printing paper P is conveyed and processed within the processor section 14 with the image forming surface thereof facing upward. The dried photographic printing paper P is discharged, at an upward diagonal and with the image forming surface thereof facing downward, by conveying rollers 17 provided in a vicinity of a discharge opening 16.

Within the stacking device 12, a plurality of conveying rollers 18A–E which convey the photographic printing paper P upward are disposed above the discharge opening 16. The conveying path of the photographic printing paper P formed by the conveying rollers 18A–E is circular-arc-shaped and is convex toward the side in the direction of arrow L. The conveying rollers 18A–E can be rotated forward and reversely by a motor (not shown).

A conveying guide 20, which is substantially triangular and swingable, is disposed between the discharge opening 16 and the conveying rollers 18A.

The conveying guide 20 is switched, by an unillustrated actuator such as a solenoid (or a motor) or the like, between the position illustrated by the solid line in FIG. 2 and the position illustrated by the imaginary line in FIG. 2.

A transmitted-light-type light sensor 22, which detects the passing of the photographic printing paper P, is provided above the conveying guide 20.

A large tray 24, in which are stacked large-sized photographic printing papers P (photographic printing papers which are larger than the usual service sizes, e.g., 8×10 inch size), is disposed at the arrow L direction side of the conveying guide 20.

A plurality of conveying rollers 26A–D are disposed horizontally along the direction of arrow L and the direction of arrow R above the conveying rollers 18E. The conveying rollers 26A–D can be rotated forward and reversely by an unillustrated motor.

The photographic printing paper P discharged via the conveying rollers 18A–E is inserted toward the conveying rollers 26C which are positioned at a substantially intermediate portion.

A transmitted-light-type light sensor 28, which detects the width of the photographic printing paper P (the dimension in the direction perpendicular to the surface of the paper on which FIG. 1 is illustrated), is disposed at the arrow R direction side of the conveying rollers 26D.

A conveying guide 27 is provided between the conveying rollers 26B and the conveying rollers 26C. The conveying guide 27 is switched, by an unillustrated actuator such as a solenoid (or a motor) or the like, between the position illustrated by the solid line in FIG. 2 and the position illustrated by the imaginary line in FIG. 2.

Figure 3:
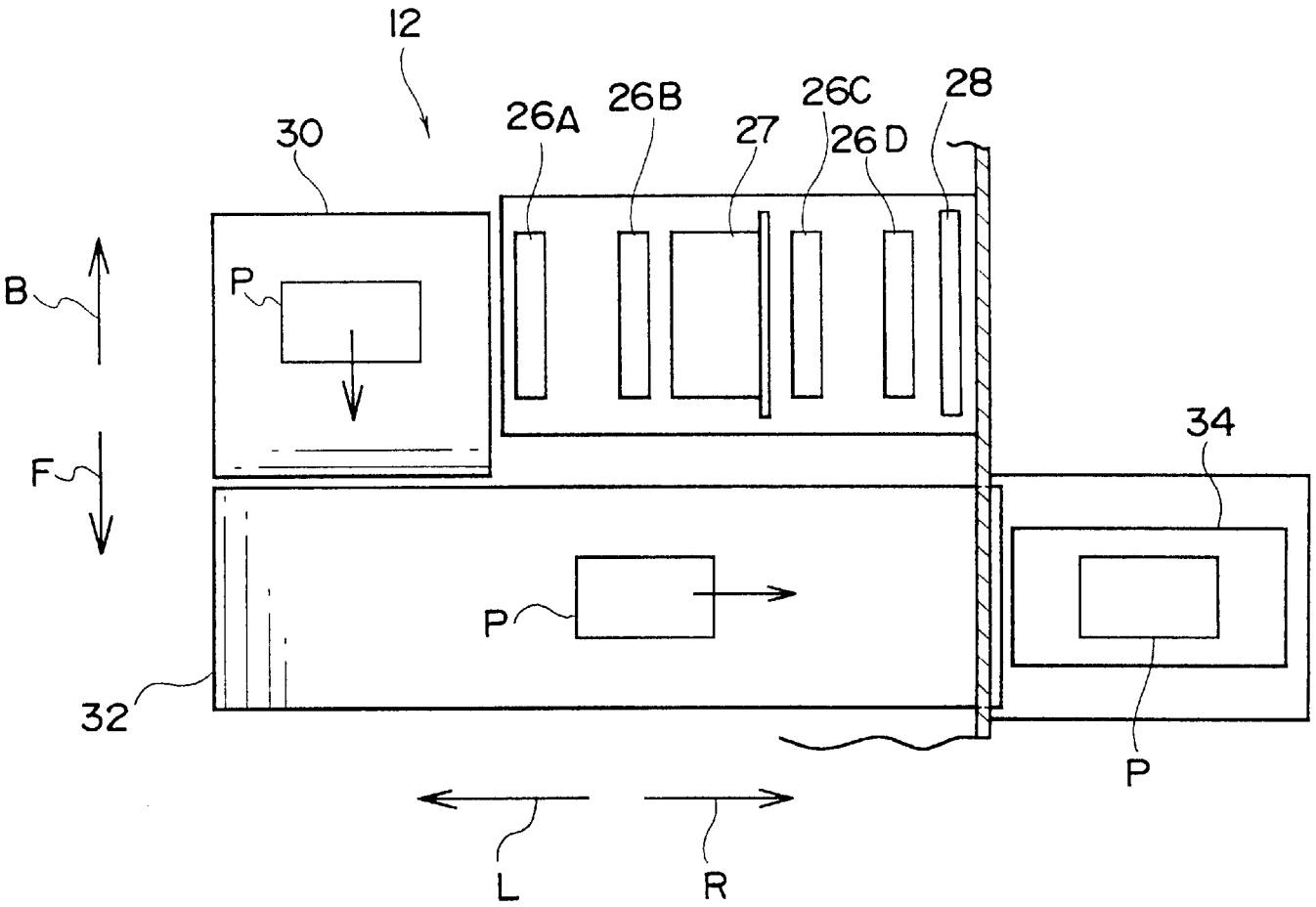
FIG. 3 is a plan view of the main portions illustrated in FIG. 1.

As illustrated in FIG. 3, a belt conveyor 30, whose conveying direction is the direction (the direction of arrow F) perpendicular to the conveying direction of the conveying rollers 26A–D, is provided at the arrow L side of the conveying rollers 26A.

As shown in FIGS. 2 and 3, a belt conveyor 32, whose conveying direction is the direction (the direction of arrow R) perpendicular to the conveying direction of the belt conveyor 30, is provided below and at the arrow F direction side of the belt conveyor 30.

As shown in FIG. 1, a sorter 36, which serves as an accommodating portion and has a plurality of trays 34 disposed substantially horizontally, is provided at the arrow R direction side of the belt conveyor 32. The trays 34 are provided at predetermined intervals in the vertical direction, and freely move integrally in the vertical direction along guides 38 which extend in the vertical direction.

Small-size photographic printing papers P, e.g., usual service size photographic printing papers P, whose widths are smaller than those of the large-size photographic printing papers P which are stacked in the large-size tray 24, are stacked in the trays 34.

A pair of upper and lower sprockets 40 are provided at the sorter 36. An endless chain 42 is trained around the sprockets 40. One of the sprockets 40 is rotated by a motor 44. The trays 34 are connected to the endless chain 42, and are moved up and down by rotation of the motor 44.

The actuator driving the conveying guide 20, the light sensor 22, the light sensor 28, the actuator driving the conveying guide 27, the conveying rollers, and the motor driving the belt conveyor are controlled by a control device 46.

The front side of the printer processor 10 is the side in the direction of arrow F in the drawings.

Operation of the present first embodiment will be described hereinafter.

First, sorting of small-size photographic printing papers P will be explained.

In the initial state at the apparatus, the conveying guide 20 is at the position illustrated by the solid line in FIG. 2. A small-size photographic printing paper P which has been dried is discharged, with the image forming surface thereof facing downward, from the discharge opening 16 of the processor section 14.

The photographic printing paper P which has been discharged from the discharge opening 16 is conveyed upward via the conveying guide 20 by the conveying rollers 18A–E which rotate in the directions of arrows A.

The conveying guide 27 is first in the inclined state as illustrated by the solid line in FIG. 2. The conveying rollers 26A–D rotate in the directions of arrows C. After the photographic printing paper P discharged from the conveying rollers 18E has been inserted between the conveying rollers 26C via the conveying guide 27, the photographic printing paper P is conveyed in the direction of arrow R.

When the photographic printing paper P is conveyed in the direction of arrow R, the width of the photographic printing paper P is detected by the light sensor 28, and the control device 46 judges whether the photographic printing paper P is large-size (wide) or small-size (narrow).

If it is determined that the photographic printing paper P is narrow, the conveying rollers 26A–D are rotated reversely, and the conveying guide 27 is switched to its horizontal position as illustrated by the imaginary line in FIG. 2. The photographic printing paper P is conveyed in the direction of arrow L and is discharged onto the belt conveyor 30.

As illustrated in FIG. 3, the photographic printing paper P is conveyed in the direction of arrow F by the belt conveyor 30, and is discharged onto the belt conveyor 32.

Then, the belt conveyor 32 conveys the photographic printing paper P in the direction of arrow R, and discharges the photographic printing paper P to the tray 34 of the sorter 36.

Thereafter, small-size photographic printing papers P are discharged to and stacked on the tray 34 in the same manner.

In the present first embodiment, the small-size photographic printing paper P is discharged from the discharge opening 16 of the processor section 14 with the image forming surface facing downward. Thereafter, the photographic printing paper P is transferred from the conveying rollers 18A–E to the conveying rollers 26C, and the image forming surface is oriented upward. From then on, the photographic printing paper P is discharged to the tray 34 of the sorter 36 with the image forming surface facing upward. Therefore, the small-size photographic printing paper P is stacked in the tray 34 with the image facing surface upward, and the images of the stacked photographic printing papers P can be easily confirmed.

When the photographic printing papers P of one order are stacked, the tray 34 is moved upward (or downward), such that an empty tray 34 is positioned at the discharge side of the belt conveyor 32 in preparation for the stacking of the photographic printing papers P of the next order.

A case in which a large-size photographic printing paper P is discharged from the discharge opening 16 of the processor section 14 will be described.

In the same way as the small-size photographic printing paper P, the large-size photographic printing paper P is transferred to the conveying rollers 26C from the conveying rollers 18A–E via the conveying guide 27.

The large-size photographic printing paper P is conveyed in the direction of arrow R by the conveying rollers 26C, D. The width of the photographic printing paper P is detected by the light sensor 28, and the control device 46 judges whether the photographic printing paper P is large-size (wide) or small-size (narrow).

When it is judged that the photographic printing paper P is wide, the conveying guide 27 is maintained at the position illustrated by the solid line in FIG. 2, and the conveying rollers 26A–D and the conveying rollers 18A–E are rotated reversely. The large-size photographic printing paper P is returned to the conveying rollers 18E–A via the conveying guide 27, and is conveyed back downwardly.

When the conveying direciton trailing end of the large-size photographic printing paper P is detected by the light sensor 22 and the photographic printing paper P is conveyed downward a predetermined amount, the conveying guide 20 is switched to the position illustrated by the imaginary line in FIG. 2. Thereafter, the conveying rollers 18A–E are rotated forwardly, and the large-size photographic printing paper P is discharged onto the large-size tray 24 via the conveying guide 20.

Second Embodiment

A second embodiment of the present invention will be described in accordance with FIGS. 4 through 6. Structures which are the same as those in the previously-described embodiment are denoted by the same reference numerals, and description thereof is omitted.

Figure 4:
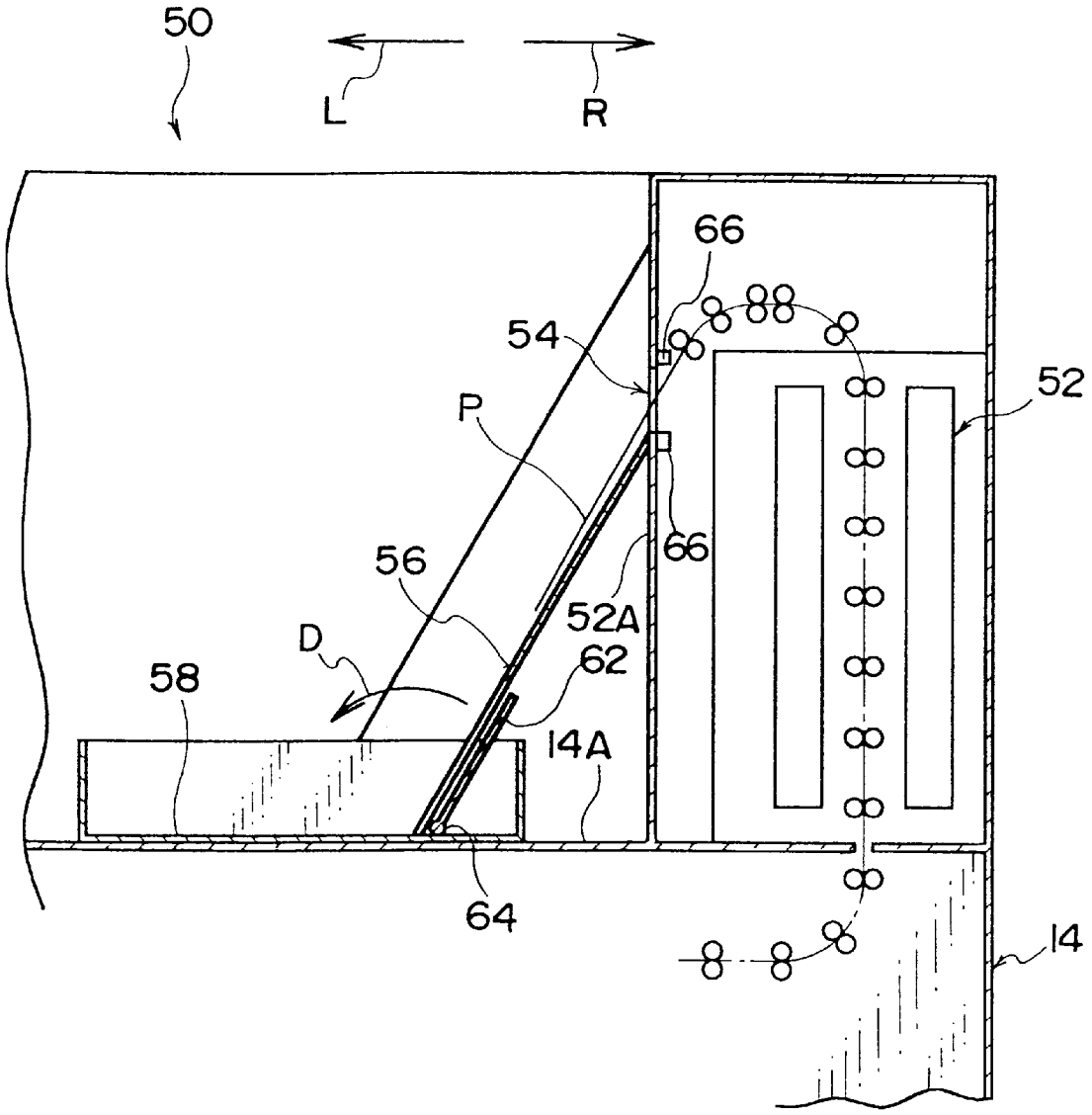
FIG. 4 is a cross-sectional view, as viewed from the front, of main portions of a photosensitive material processing apparatus relating to a second embodiment of the present invention.

As illustrated in FIG. 4, in a printer processor 50 of the present second embodiment, a photographic printing paper P which passes through a drying section 52 is discharged from a discharge opening 54 with the image forming surface facing downward.

An inclined paper guide 56 is disposed at the arrow L direction side surface of the drying section 52. A tray 58 is disposed horizontally at the bottom of the paper guide 56.

Figure 5:
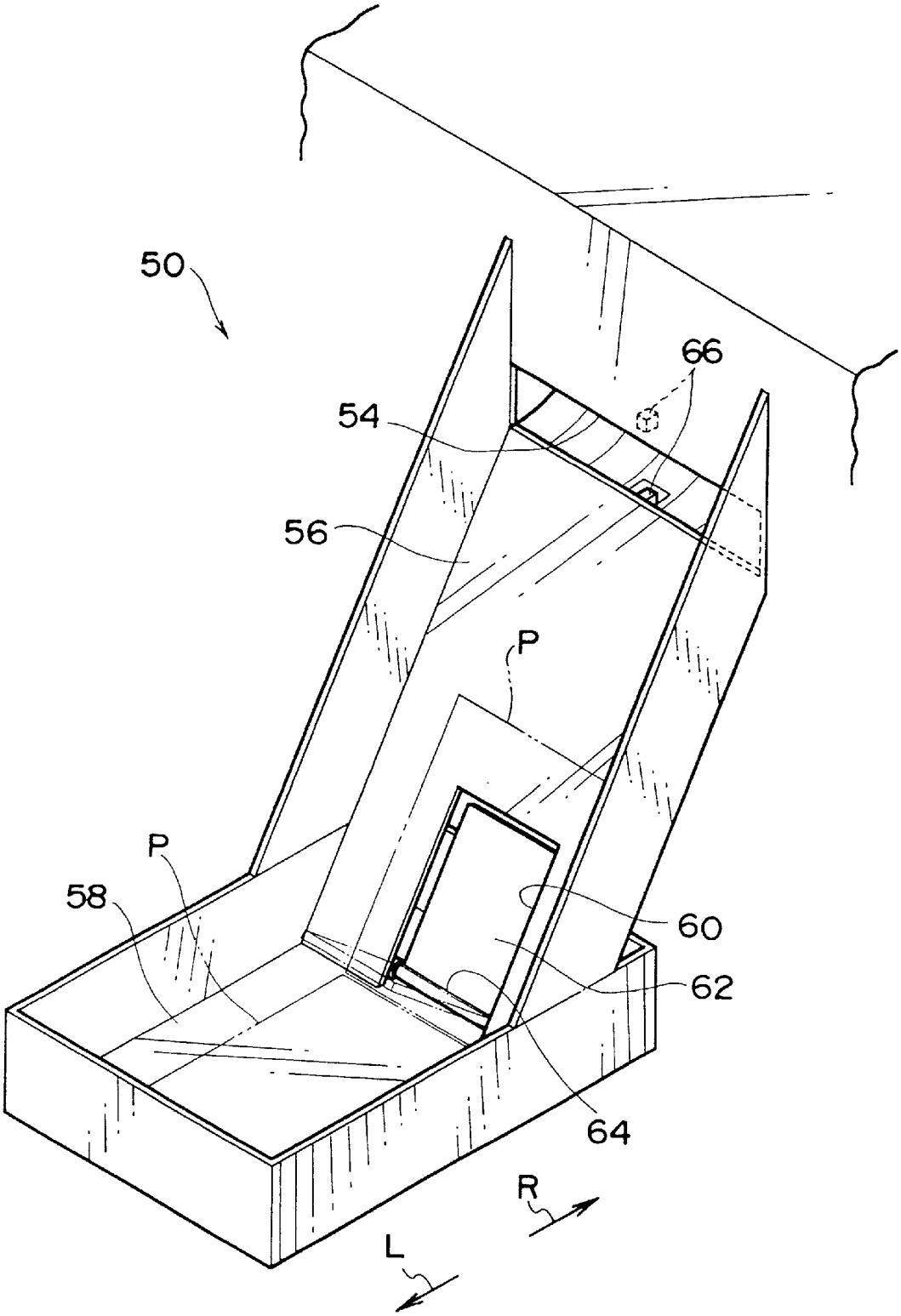
FIG. 5 is a perspective view of the main portions of the photosensitive material processing apparatus illustrated in FIG. 4.

As shown in FIG. 5, a cut-out 60 is formed in the center of the paper guide 56. A reversing guide 62 is disposed within the cut-out 60.

A lower end shaft 64 illustrated in FIG. 4 is connected to an actuator (not shown). The reversing guide 62 is swingable about the shaft 64 in the direction of arrow D and in the direction opposite thereto.

A transmitted-light-type light sensor 66 which detects the photographic printing paper P is disposed at the discharge opening 54. An actuator which drives the light sensor 66 and the reversing guide 62 is connected to the control device 46. The actuator is controlled on the basis of detection signals of the light sensor 66.

Next, operation of the present second embodiment will be described.

The photographic printing paper P from the discharge opening 54 of the processor section 14 is discharged with the image forming surface thereof facing downward, and falls down onto the paper guide 56.

Figure 6:
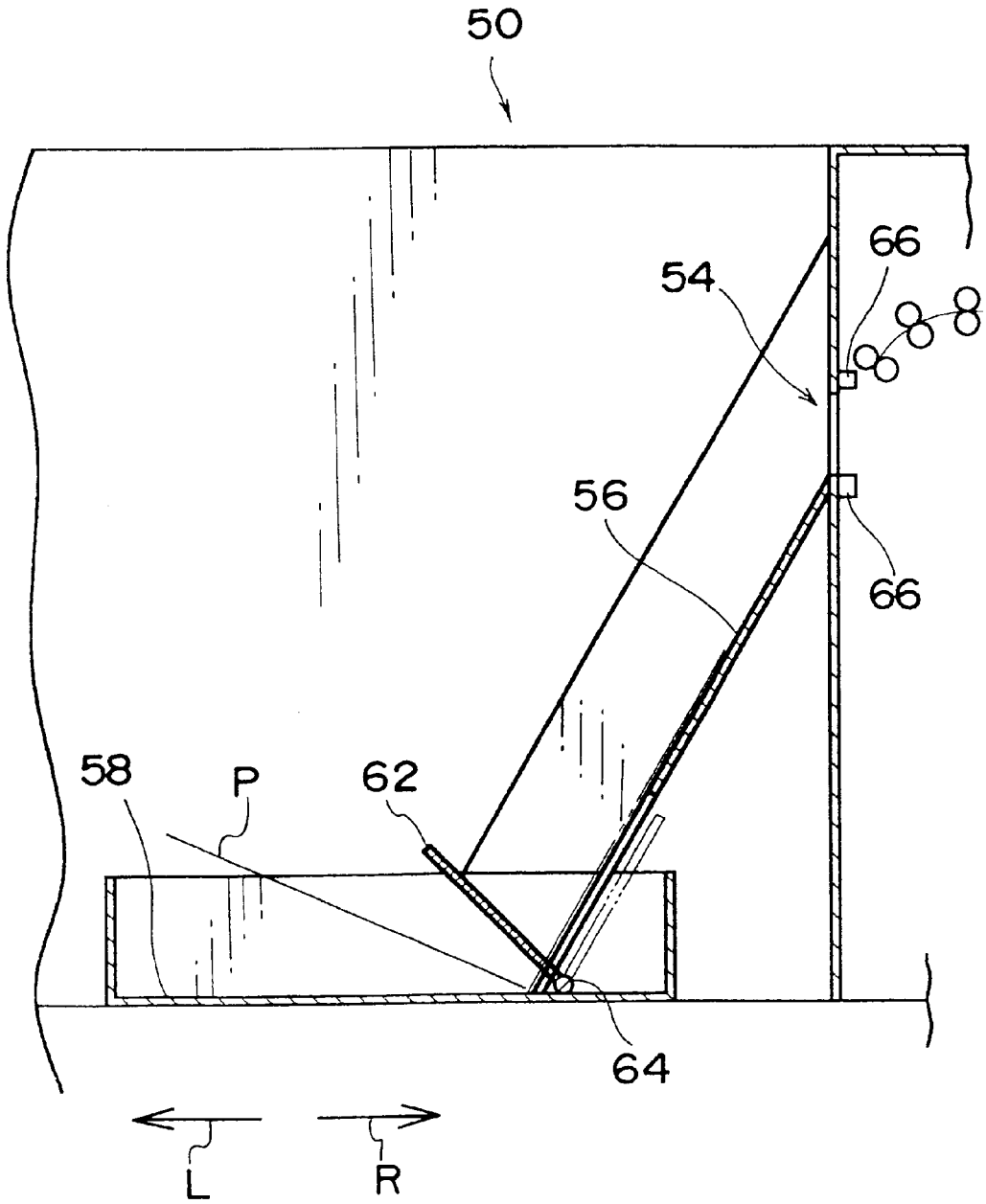
FIG. 6 is a cross-sectional view of the main portions illustrated in FIG. 5.

When a predetermined period of time passes after the conveying direction trailing end of the photographic printing paper P is detected by the light sensor 66, the reversing guide 62 is swung in the direction of arrow D from the state illustrated in FIG. 4 to the state illustrated in FIG. 6. The photographic printing paper P is thereby stacked on the tray 58 with the image forming surface facing upward. Thereafter, the reversing guide 62 is swung in the direction opposite to the direction of arrow D, and is returned to its initial position parallel to the paper guide 56.

In the present second embodiment, the photographic printing paper P discharged with the image forming surface thereof facing downward is reversed by the reversing guide 62, and is always stacked with the image forming surface facing upward. Therefore, the images of the stacked photographic printing papers P can easily be confirmed.

The reversing guide 62 and the paper guide 56 may be formed integrally such that the paper guide 56 is movable.

Further, the paper guide 56 may be formed integrally with a cover 52A which covers the drying portion 52, or may be formed integrally with a processing section cover 14A of the processing section 14.

Moreover, the tray 58 may be formed integrally with the processing section cover 14A of the processing section 14.

Third Embodiment

A third embodiment of the present invention will be described hereinafter with reference to FIGS. 7 through 9. Structures which are the same as those of the previously-described embodiments are denoted by the same reference numerals, and description thereof is omitted.

Figure 7:
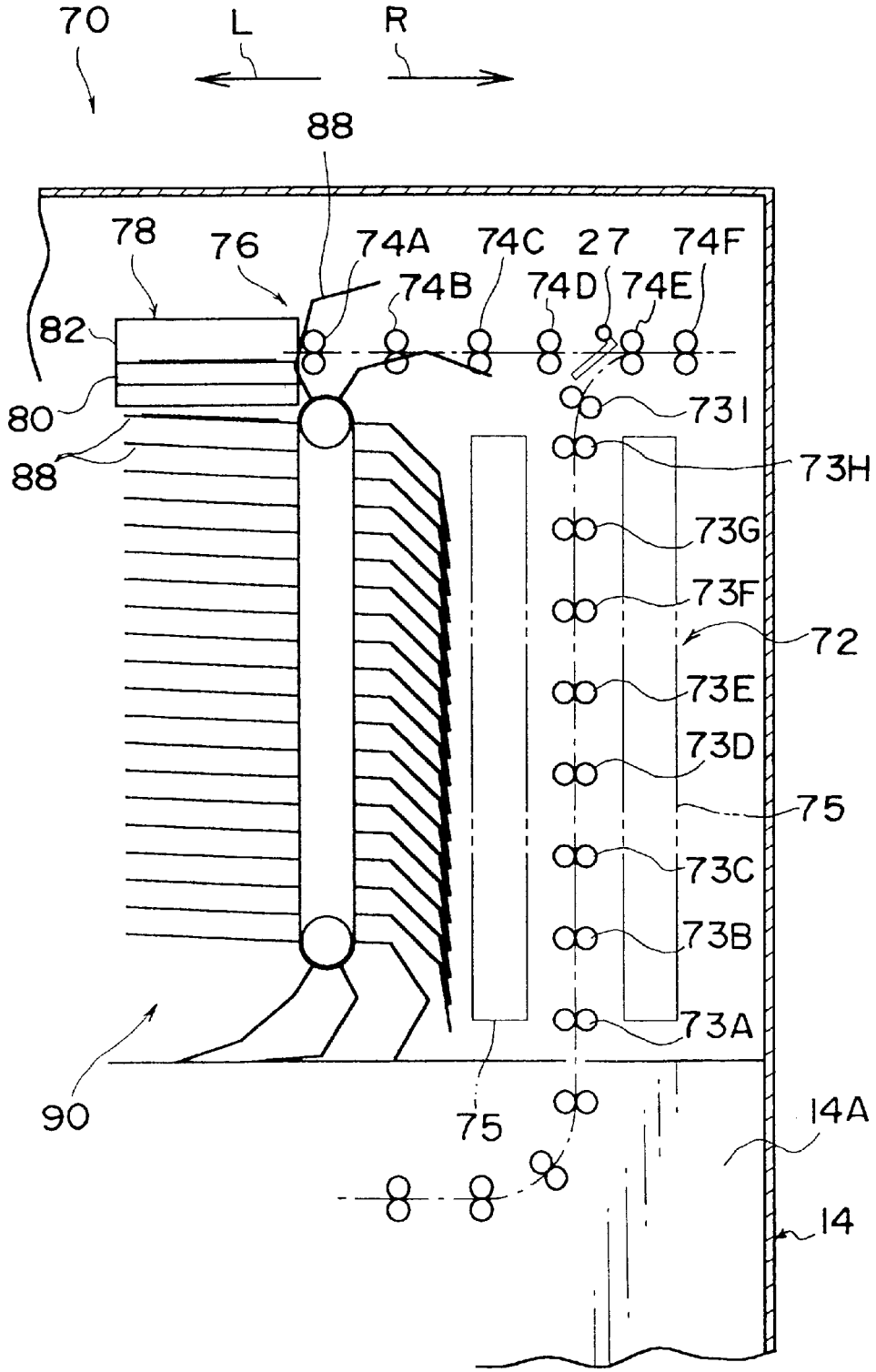
FIG. 7 is a cross-sectional view, as viewed from the front, of main portions of a photosensitive material processing apparatus relating to a third embodiment of the present invention.

As illustrated in FIG. 7, in a printer processor 70 of the present third embodiment, a photographic printing paper P discharged from a washing portion 14A of the processor section 14 is conveyed to a drying portion 72 provided above the washing portion 14A.

Conveying rollers 73A–I which convey the photographic printing paper P upwardly are provided in the drying section 72. Nozzles 75 which blow drying air out toward the photographic printing paper P are disposed at the both sides of the conveying rollers 73A–I.

Above the conveying rollers 73I, a plurality of conveying rollers 74A–F are disposed horizontally along the direction of arrow L and the direction of arrow R. The conveying rollers 74A–F can be rotated forwardly and reversely by a motor (not shown).

The photographic printing paper P which is discharged from the drying portion 72 is inserted toward the conveying rollers 74E positioned at a substantially intermediate portion.

In the same way as in the first embodiment, the conveying guide 27 is provided between the conveying rollers 74D and the conveying rollers 74E.

A discharge opening 76 is provided at the arrow L direction side of the conveying rollers 74A. The photographic printing paper P is discharged from the discharge opening 76 with the image forming surface thereof facing downward.

In the printer processor 70 of the present third embodiment, the photographic printing papers P are subjected to developing processing in plural rows. As illustrated in FIGS. 8 and 9, the dried photographic printing papers P are successively discharged from the discharge opening 76. Accordingly, the printer processor 70 of the present third embodiment is formed such that the conveying path up to the discharge opening 76 is wide. A reversing device 78, which returns the photographic printing papers P in plural rows to a single row and orients the image forming surfaces thereof upward, is disposed at the arrow L direction side of the discharge opening 76.

Figure 8:
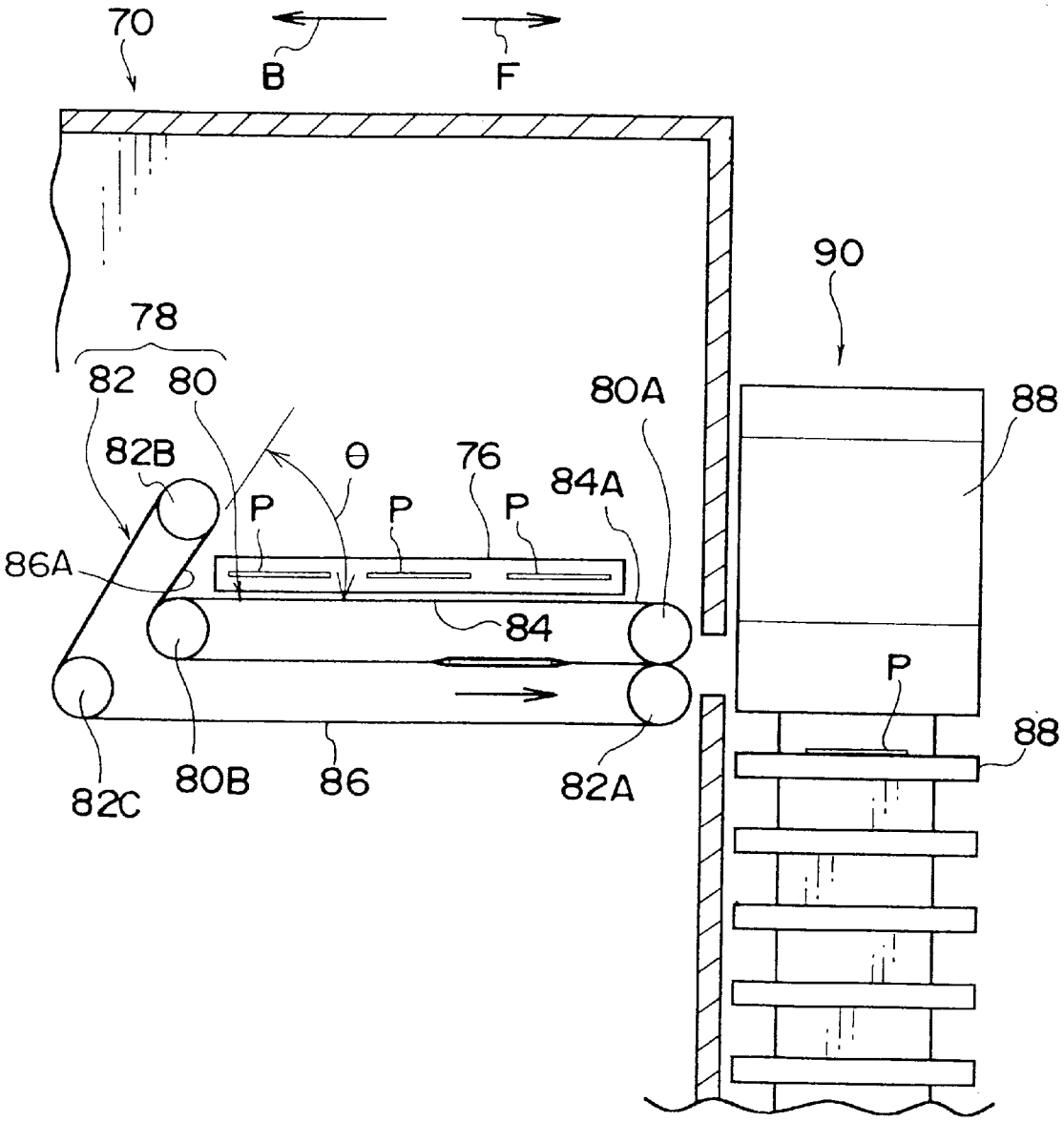
FIG. 8 is an enlarged view of the main portions of the photosensitive material processing apparatus illustrated in FIG. 7.

As illustrated in FIG. 8, the reversing device 78 is provided with a first belt conveyor 80 and a second belt conveyor 82.

Figure 9:
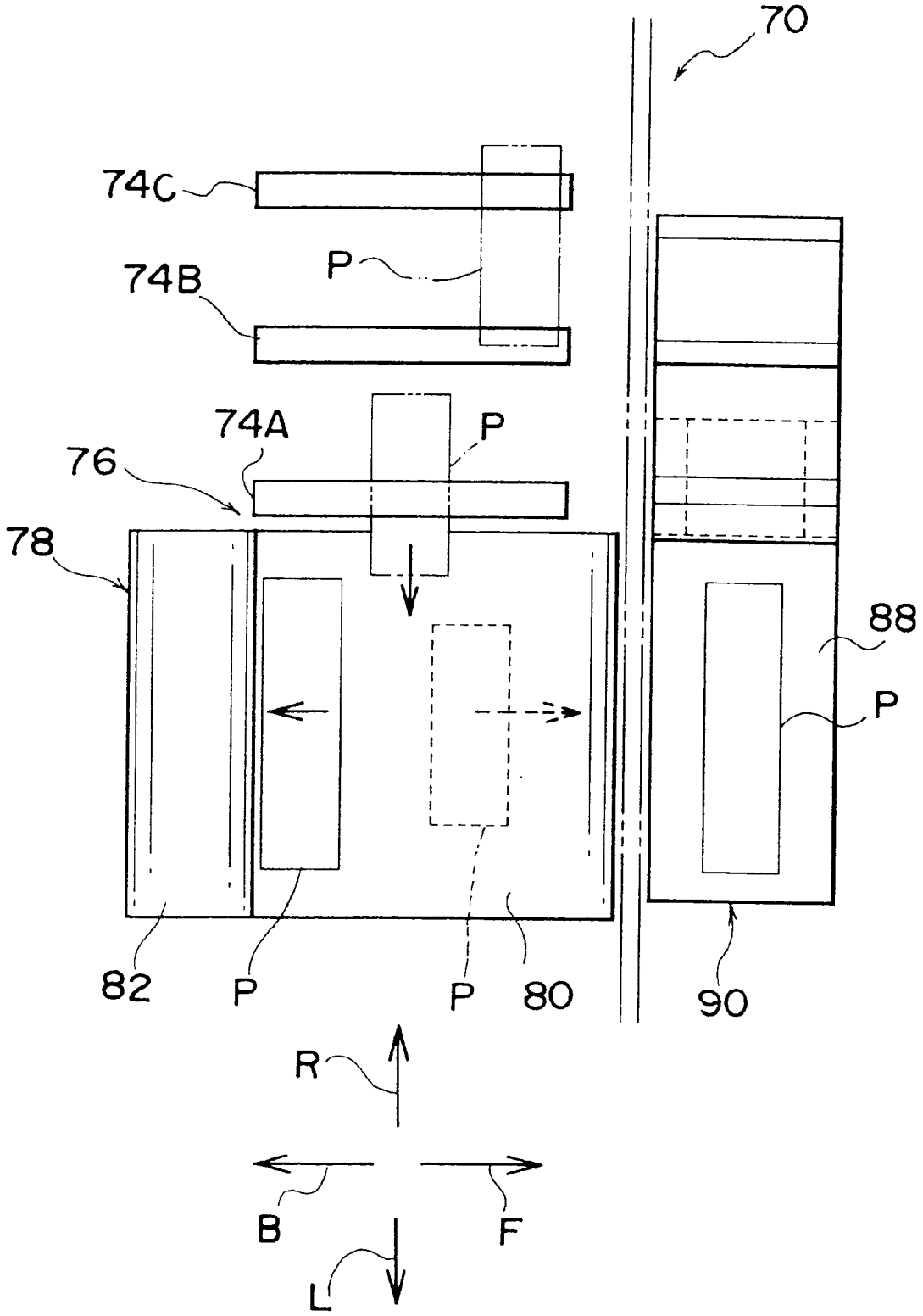
FIG. 9 is a plan view of the main portions illustrated in FIG. 7.

As shown in FIGS. 8 and 9, the conveying direction of the first belt conveyor 80 is a direction orthogonal to the conveying direction of the conveying rollers 74A–F. The first belt conveyor 80 has a pair of pulleys 80A, 80B. An endless belt 84 is trained about the pulleys 80A, 80B.

The second belt conveyor 82 has a pulleys 82A, 82B, and 82C. The pulley 82A is disposed beneath and adjacent to the pulley 80A of the first belt conveyor 80. The pulley 82B is disposed above the pulley 80B of the first belt conveyor 80. The pulley 82C is disposed downwardly and diagonally at the arrow B direction side of the pulley 80B of the first belt conveyor 80. An endless belt 86 is trained about the pulleys 82A–C. A portion of the endless belt 86 and a portion of the endless belt 84 of the first belt conveyor 80 are fit closely to one another.

The first belt conveyor 80 and the second belt conveyor 82 are driven by a common motor (not shown).

A sorter 90 of a type in which a plurality of trays 88 circulate is disposed at the arrow F direction side of the reversing device 78.

Next, operation of the present third embodiment will be described.

As illustrated in FIGS. 8 and 9, the photographic printing paper P is discharged, with the image forming surface thereof facing downward, from the discharge opening 76 onto the first belt conveyor 80 of the reversing device 78.

The photographic printing paper P on the first belt conveyor 80 is conveyed in the direction of arrow B, is sandwiched between the endless belt 84 and the endless belt 86, makes a U-turn such that the front and back thereof are reversed, and is discharged from the arrow F direction side onto the tray 88 of the sorter 90 with the image forming surface facing upward.

In the present third embodiment as well, the photographic printing papers P are stacked in the tray 88 with the image forming surfaces oriented upward. Therefore, the images of the stacked photographic printing papers P can be easily confirmed.

As illustrated in FIG. 8, in order for the photographic printing paper P to be introduced easily between the endless belt 84 and the endless belt 86, it is preferable for an angle θ between a top surface 84A of the endless belt 84 and an inclined surface 86A of the endless belt 86 to be 10 to 60 degrees.

Fourth Embodiment

A fourth embodiment of the present invention will be described hereinafter with reference to FIGS. 10 through 12. Structures which are the same as those of the previously-described embodiments are denoted by the same reference numerals and description thereof is omitted.

Figure 10:
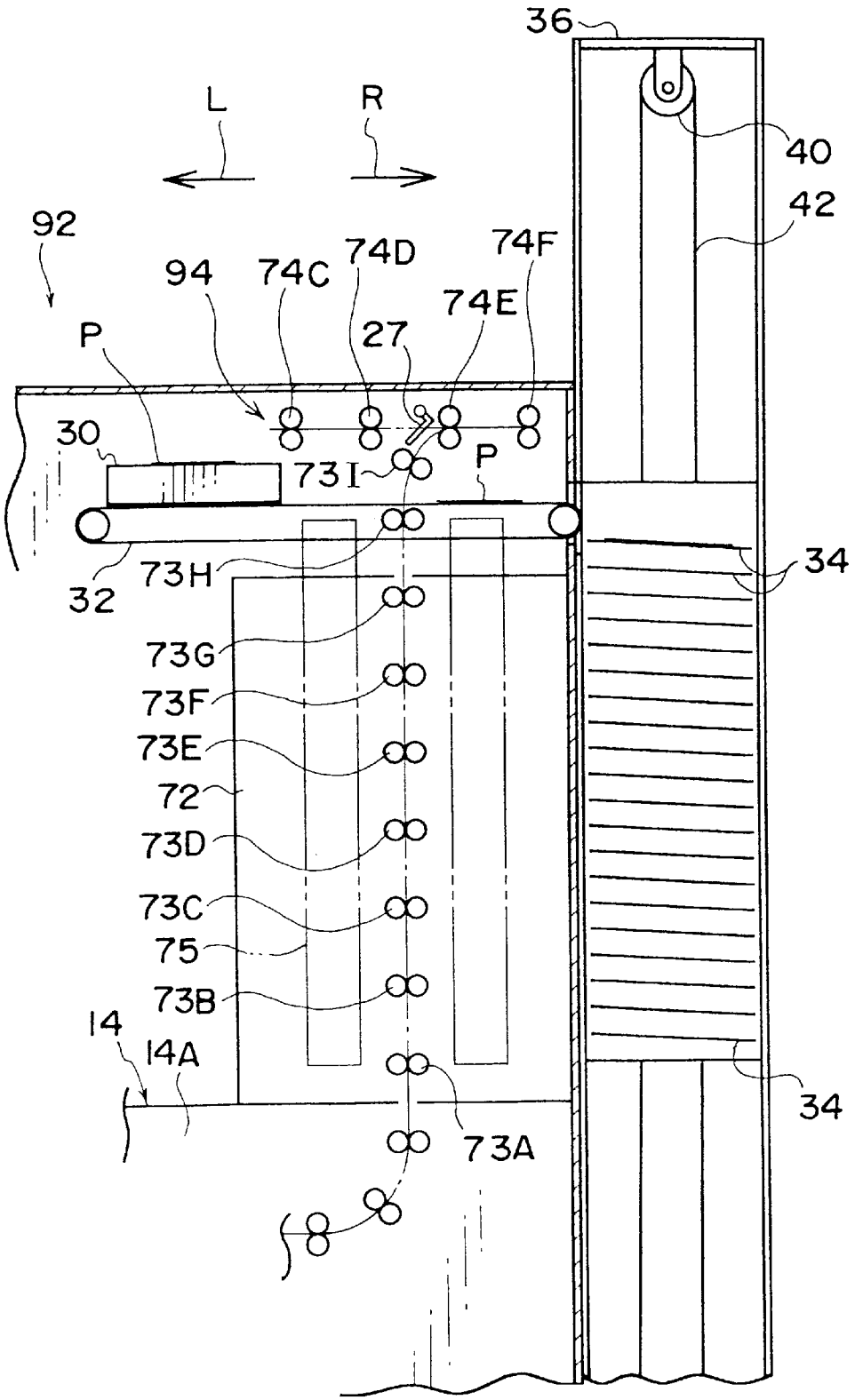
FIG. 10 is a cross-sectional view, as viewed from the front, of main portions of a photosensitive material processing apparatus relating to a fourth embodiment of the present invention.
Figure 11:
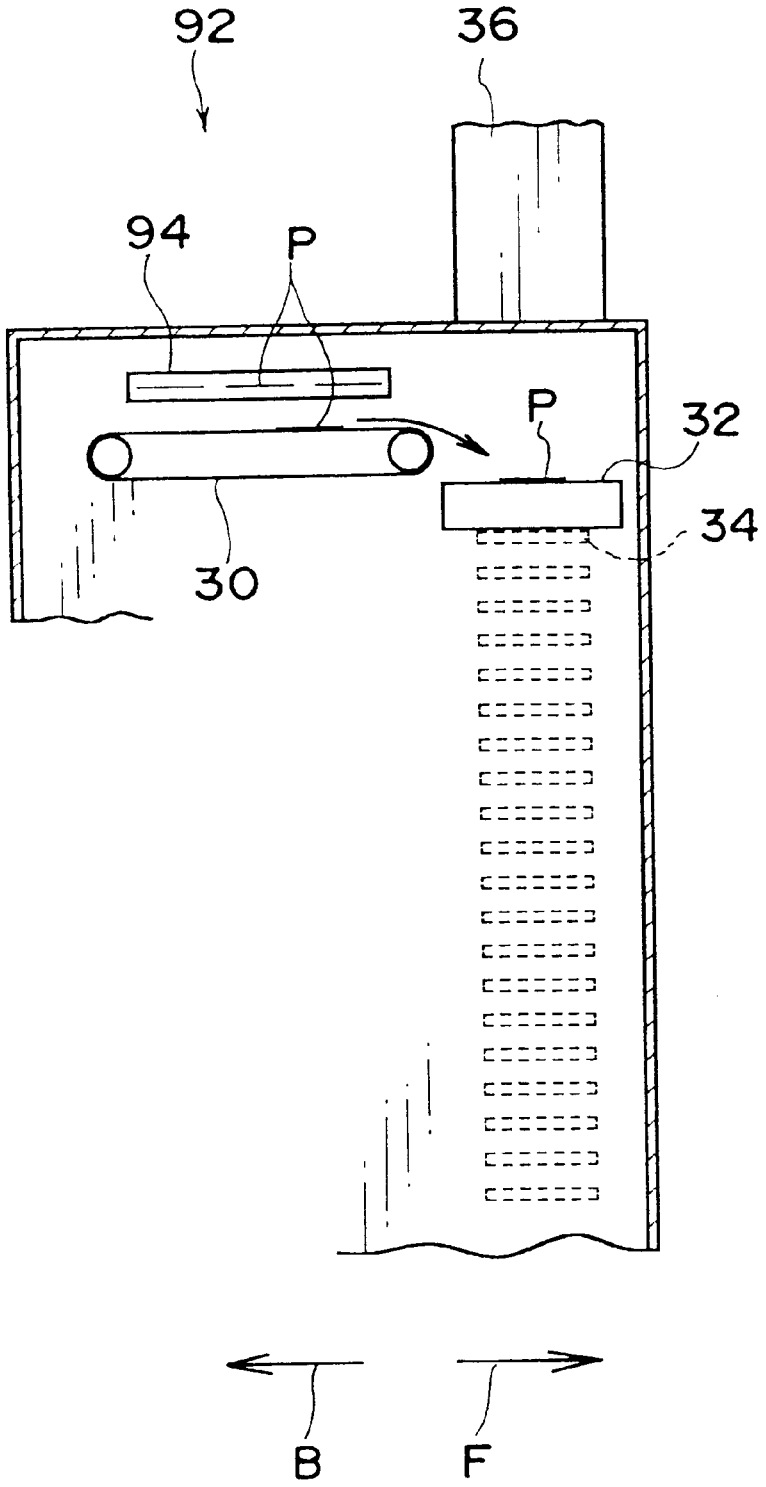
FIG. 11 is a left side view of the photosensitive material processing apparatus illustrated in FIG. 10.
Figure 12:
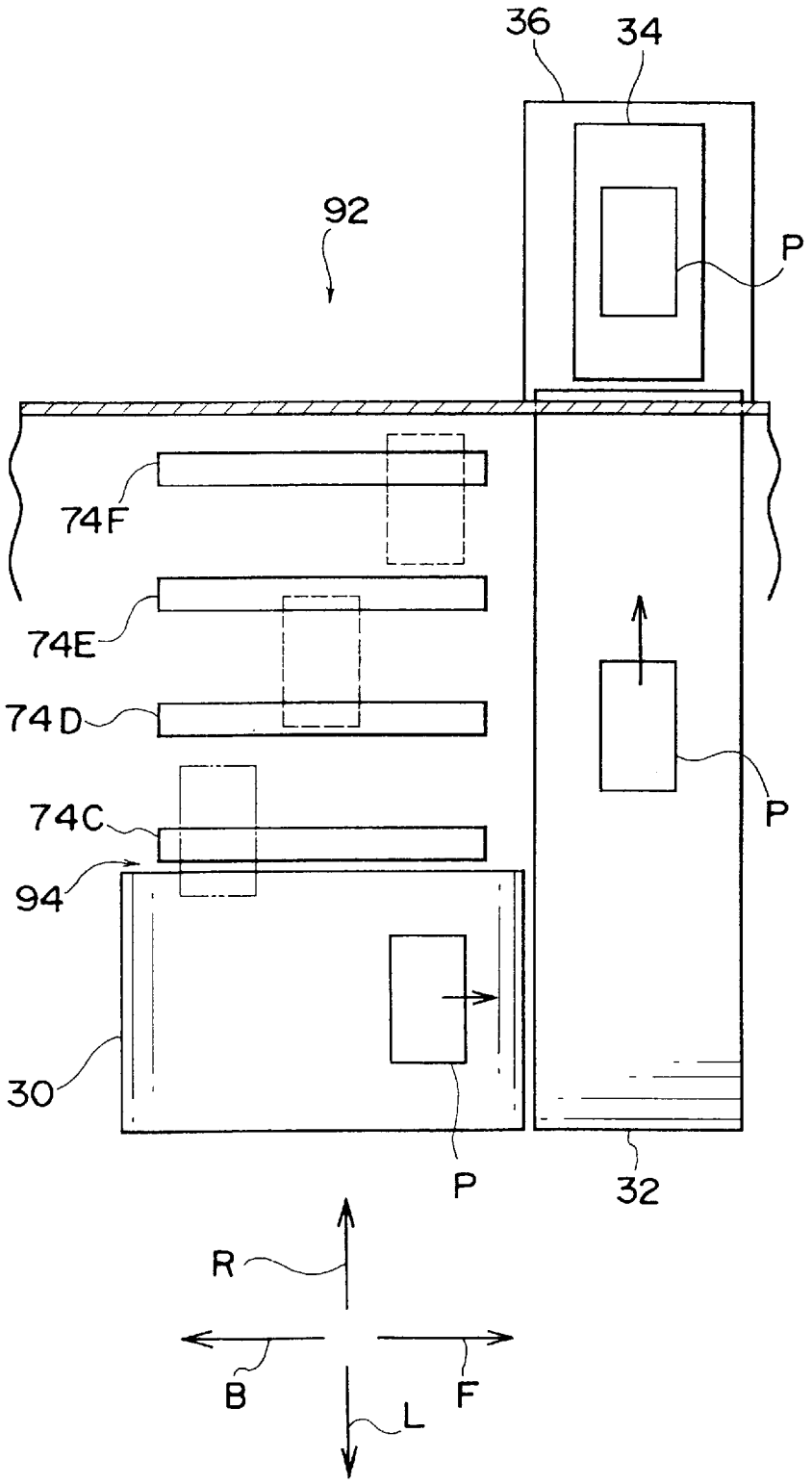
FIG. 12 is a plan view of the main portions of the photosensitive material processing apparatus illustrated in FIG. 10.

As illustrated in FIGS. 10 through 12, in a printer processor 92 of the present fourth embodiment, a photographic printing paper P dried in the drying portion 72 is discharged from a discharge opening 94 with the image forming surface facing upward.

The printer processor 92 of the present fourth embodiment also is formed such that the conveying path up to the discharge opening 94 is wide, so that the photographic printing papers P can be processed from developing to drying while being conveyed in plural rows.

In the same way as in the first embodiment, the belt conveyor 30 is disposed at the arrow L direction side of the conveying rollers 74C. The belt conveyor 32 is disposed at the arrow F direction side of the belt conveyor 30, and the sorter 36 is disposed at the arrow R direction side of the belt conveyor 32.

Operation of the present fourth embodiment will now be described.

In the present fourth embodiment, the photographic printing paper P, which is discharged from the discharge opening 94 with the image forming surface thereof facing upward, is discharged, with the image forming surface thereof facing upward, to the tray 34 of the sorter 36 by the belt conveyor 30 and the belt conveyor 32.

In the present fourth embodiment as well, because the photographic printing papers P are stacked with the image forming surfaces thereof facing upward, the images of the stacked photographic printing papers P can be easily confirmed.

Further, in the printer processor 92, there is a drying structure in which the washed photographic printing papers P are dried while being conveyed vertically, and the discharge opening 94 is provided at a high position without increasing the surface area (the floor space) occupied by the apparatus. Therefore, the number of orders of photographic printing papers P which are stacked in the sorter 36, in which the trays 34 move vertically, can be increased.

Further, because the sorter 36 is structured such that the trays 34 move vertically, the number of trays 34 can be freely increased up to a vicinity of the lower surface of the belt conveyor 32.

Moreover, because the sorter 36 is provided at the front side (the side in the direction of arrow F) of the apparatus, the operation of removing the photographic printing papers P is facilitated.

Fifth Embodiment

A fifth embodiment of the present invention will be described hereinafter with reference to FIGS. 13 through 15. Structures which are the same as those of the previously-described embodiments are denoted by the same reference numerals, and description thereof is omitted.

Figure 13:
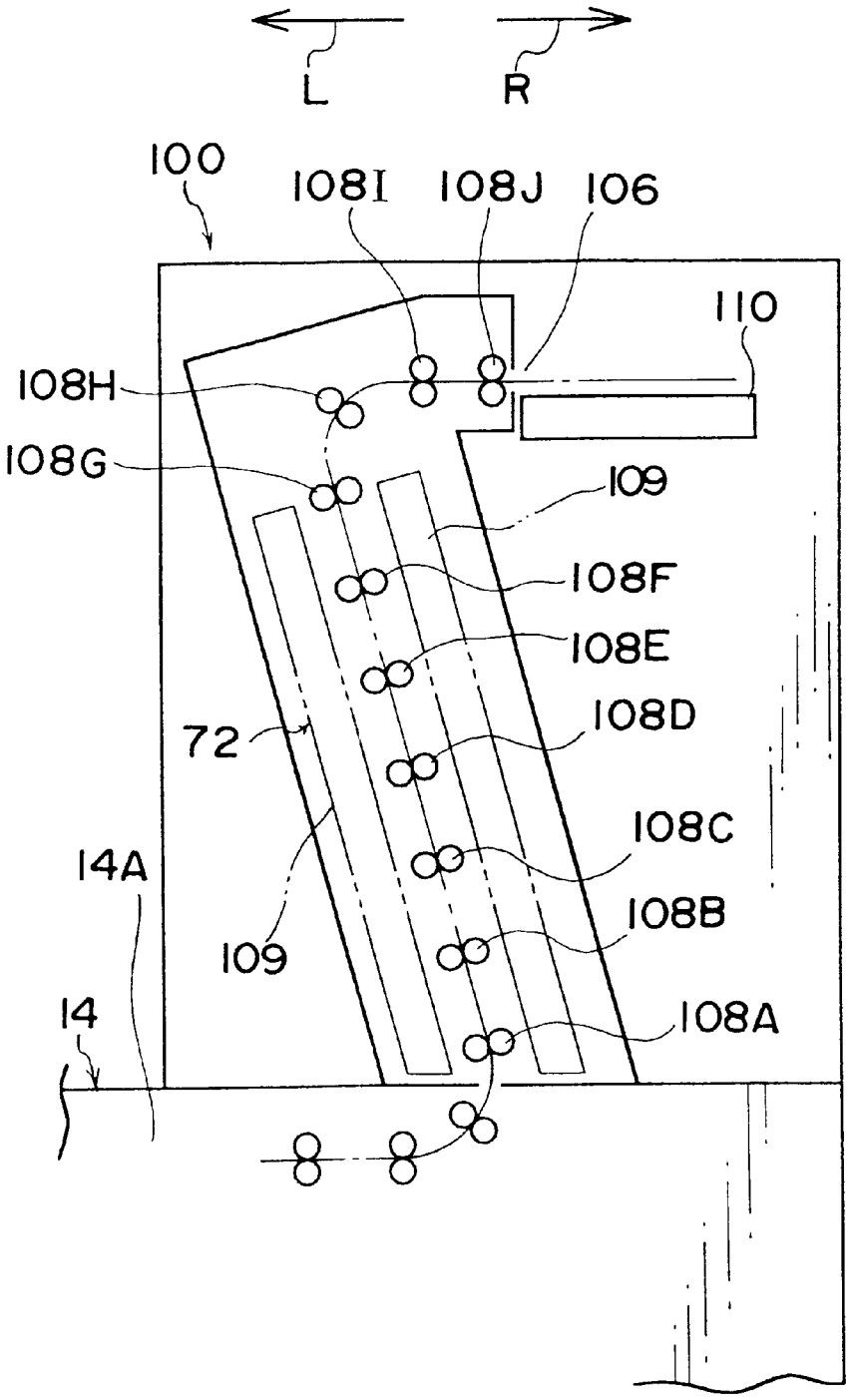
FIG. 13 is a cross-sectional view, as seen from the front, of main portions of a photosensitive material processing apparatus relating to a fifth embodiment of the present invention.

As illustrated in FIG. 13, in a printer processor 100 of the present fifth embodiment, the photographic printing papers P are processed in the processor section 14 with the image forming surfaces facing upward.

The photographic printing paper P which has been subjected to washing processing is conveyed toward the top of the washing portion 14A, and is conveyed to a drying portion 104 provided above the washing portion 14A.

A plurality of conveying rollers 108A–J are provided in the drying portion 104 of the present fifth embodiment. The conveying rollers 108A–J are rotated by a motor (not shown), so as to convey the photographic printing paper P upwardly and obliquely in the direction of arrow L, and thereafter, to discharge the photographic printing paper P toward the arrow R direction side from a discharge opening 106 provided at the top portion. Nozzles 109 which blow drying air out toward the photographic printing paper P are disposed at both sides of the conveying rollers 108A–J.

Figure 14:
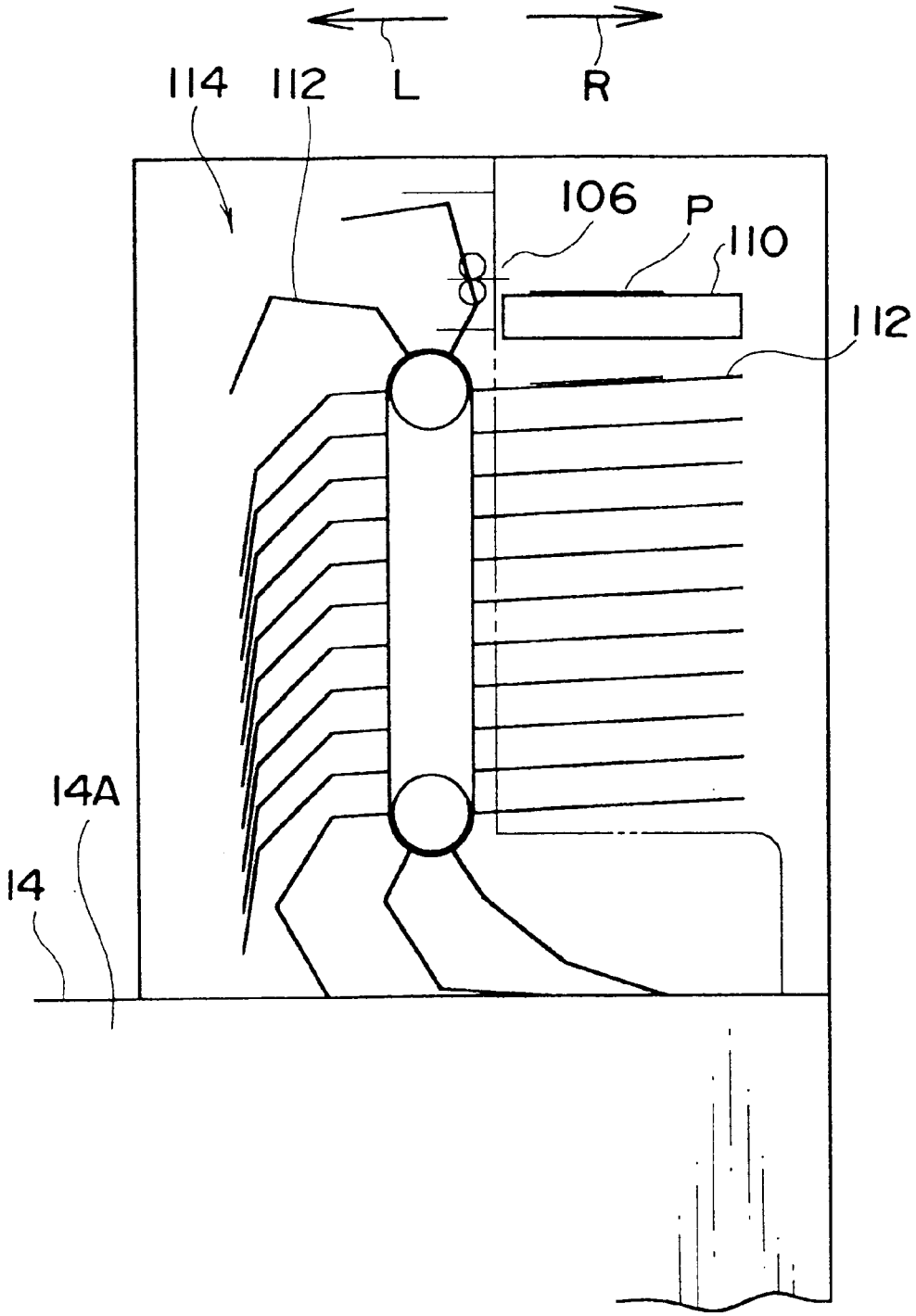
FIG. 14 is a front view of the main portions of the photosensitive material processing apparatus relating to the fifth embodiment.
Figure 15:
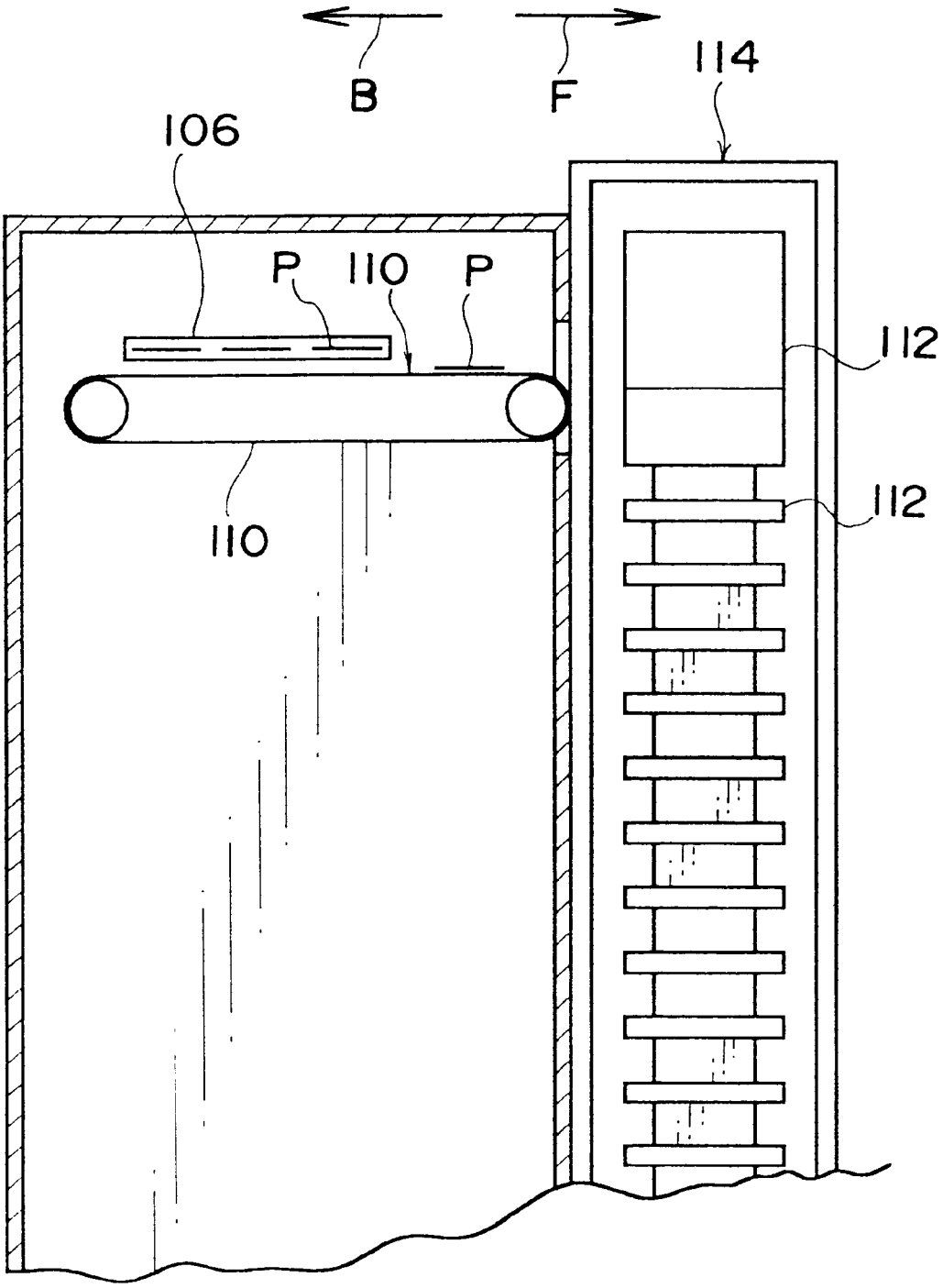
FIG. 15 is a right side view of the photosensitive material processing apparatus illustrated in FIGS. 13 and 14.

As illustrated in FIGS. 13 through 15, a belt conveyor 110, whose conveying direction is a direction orthogonal to the direction in which the photographic printing paper P is discharged, is disposed at the arrow R direction side of the discharge opening 106. In the same way as in the third embodiment, a sorter 114 in which a plurality of trays 112 circulate is disposed at the arrow F direction side of the belt conveyor 110. The sorter 114 is disposed above the washing portion 14A.

In the printer processor 100 of the present fifth embodiment as well, the conveying path up to the discharge opening 106 is formed to be wide, so that the photographic printing papers P can be processed from developing to drying while being conveyed in plural rows.

Next, operation of the present fifth embodiment will be described.

In the present fifth embodiment, the photographic printing paper P discharged from the discharge opening 106 with the image forming surface facing upward is discharged to the tray 112 of the sorter 114 by the belt conveyor 110 with the image forming surface facing upward.

In the present fifth embodiment as well, because the photographic printing papers P are stacked with the image forming surfaces thereof facing upward, the images of the stacked photographic printing papers P can be easily confirmed.

Further, because the photographic printing paper conveying path of the drying portion 104 is inclined, sufficient space can be provided for the belt conveyor 110 which changes the photographic printing papers P from being conveyed in plural rows to being conveyed in a single row, and the amount of surface area (floor space) taken up by the entire apparatus can be reduced.

Sixth Embodiment

A sixth embodiment of the present invention will be described hereinafter with reference to FIGS. 16 through 18. Structures which are the same as those of the previously-described embodiments are denoted by the same reference numerals, and description thereof is omitted.

Figure 16:
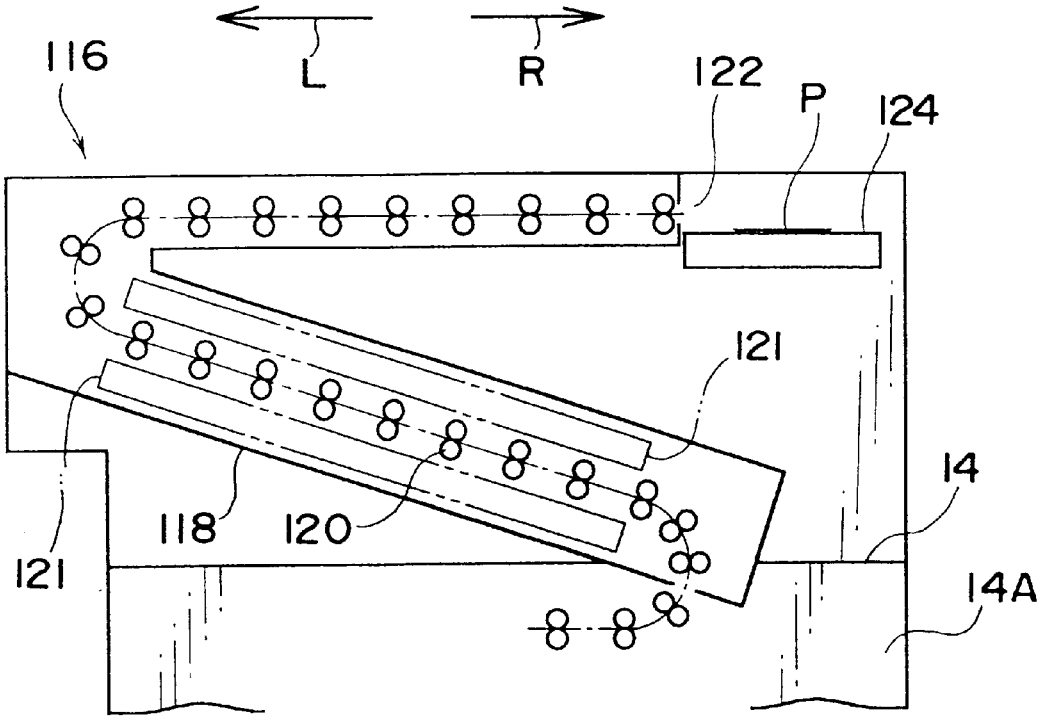
FIG. 16 is a cross-sectional view, as seen from the front, of main portions of a photosensitive material processing apparatus relating to a sixth embodiment of the present invention.

As illustrated in FIG. 16, in a printer processor 116 of the present sixth embodiment, in the same way as the printer processor 100 of the fifth embodiment, the photographic printing paper P is processed in the processor section 14 with the image forming surface thereof facing upward.

The photographic printing paper P which has been subjected to washing processing is conveyed toward the top of the washing portion 14A and into a drying portion 118 provided above the washing portion 14A.

A plurality of conveying rollers 120 is disposed in the drying portion 118 of the present sixth embodiment. The conveying rollers 120 are rotated by an unillustrated motor, and after conveying the photographic printing paper P upwardly at an incline in the direction of arrow L, discharge the photographic printing paper P toward the arrow R direction side from a discharge opening 122 provided at the arrow R direction side upper portion. Nozzles 121 which blow drying air out toward the photographic printing paper P are provided at both sides of the conveying rollers 120.

Figure 17:
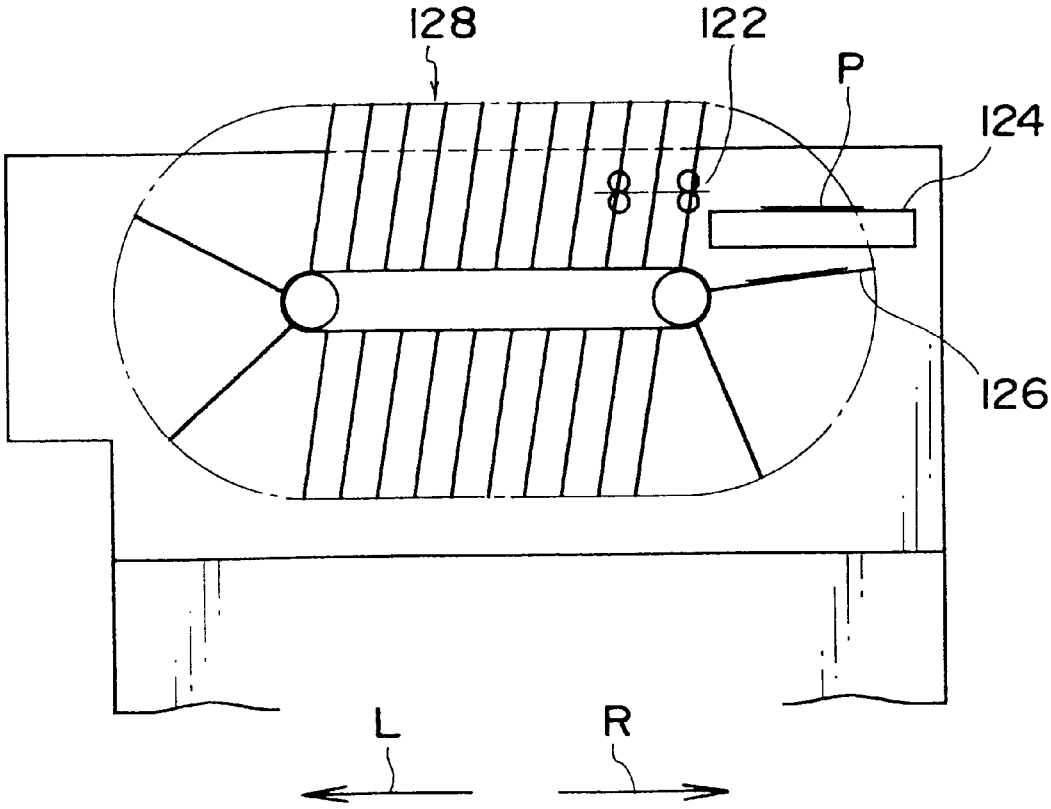
FIG. 17 is a front view of the main portions of the photosensitive material processing apparatus relating to the sixth embodiment.
Figure 18:
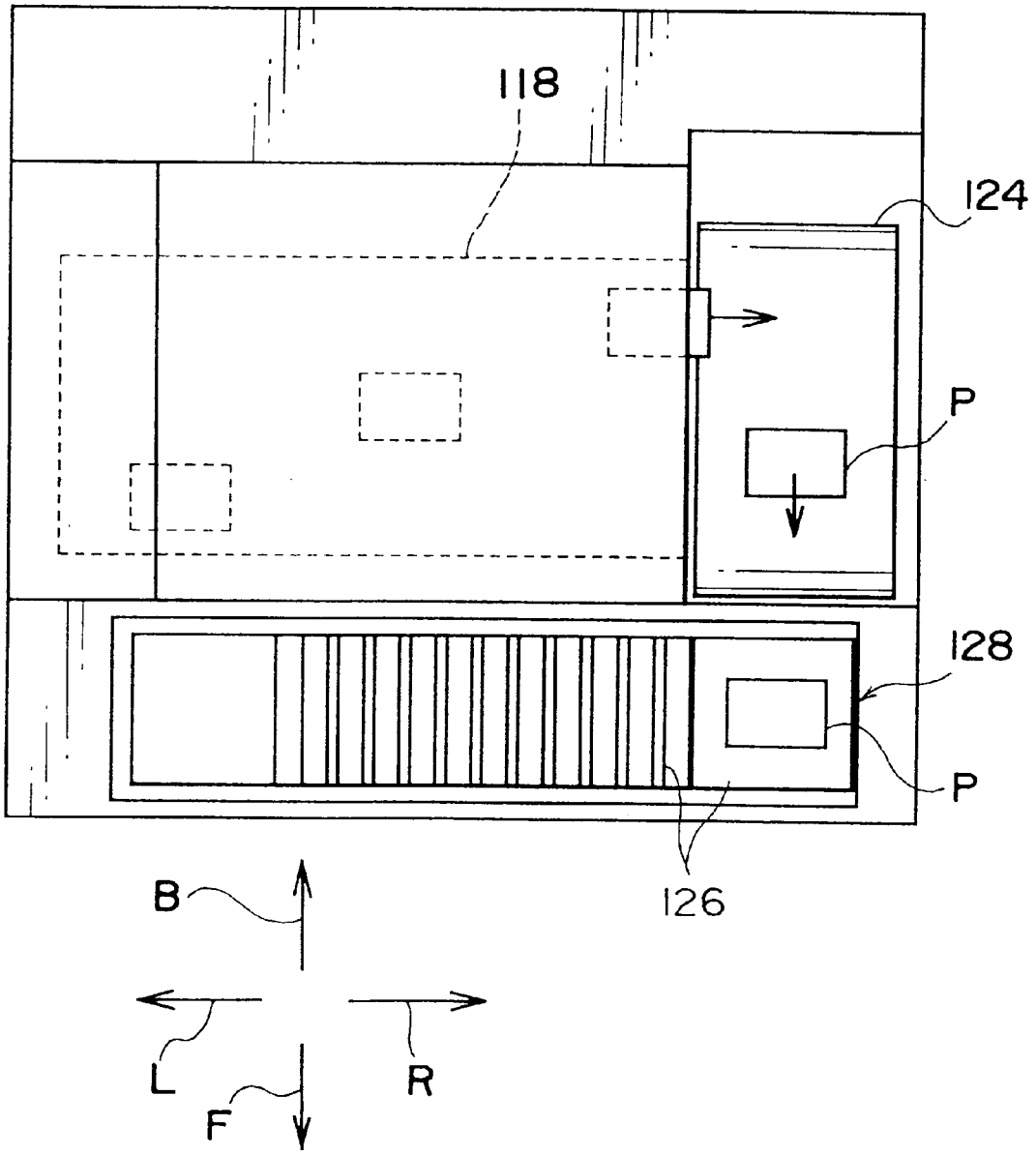
FIG. 18 is a plan view of the main portions of the photosensitive material processing apparatus illustrated in FIGS. 16 and 17.

As illustrated in FIGS. 16 through 18, a belt conveyor 124, whose conveying direction is the direction orthogonal to the direction in which the photographic printing paper P is discharged, is provided at the arrow R direction side of the discharge opening 122 of the drying portion 118. An oblong sorter 128, in which a plurality of trays 126 circulate, is disposed at the arrow F direction side of the belt conveyor 124. The sorter 128 is disposed above the washing portion 14A.

In the printer processor 116 of the present fifth embodiment as well, the conveying path up to the discharge opening 122 is formed to be wide, so that the photographic printing papers P can be processed from developing to drying while being conveyed in plural rows.

Next, operation of the present sixth embodiment will be described.

The photographic printing paper P which has been subjected to washing processing is inserted in the drying portion 118 with the image forming surface oriented in the direction of arrow L. The photographic printing paper P is first conveyed within the drying portion 118 in the direction of arrow L with the image forming surface facing downward. Thereafter, the arrow L direction side end portion is reversed such that the photographic printing paper P is conveyed in the direction of arrow R with the image forming surface thereof facing upward.

Thereafter, the photographic printing paper P which has been discharged from the discharge opening 122 is conveyed by the belt conveyor 124 to the arrow F direction side, and is discharged onto the tray 126 of the sorter 128.

In the present sixth embodiment as well, because the photographic printing papers P are stacked with the image forming surfaces thereof facing upward, the images of the stacked photographic printing papers P can be easily confirmed.

Further, the curved drying portion 118, the belt conveyor 124, and the sorter 128 are disposed at the upper portion of the photographic printing paper conveying path above the washing portion 14A. Therefore, the floor space (surface area) taken by the printer processor 116 can be reduced.

Seventh Embodiment

A seventh embodiment of the present invention will be described in accordance with FIGS. 19 and 20. Structures which are the same as those of the previously-described embodiments are denoted by the same reference numerals, and description thereof is omitted.

Figure 19:
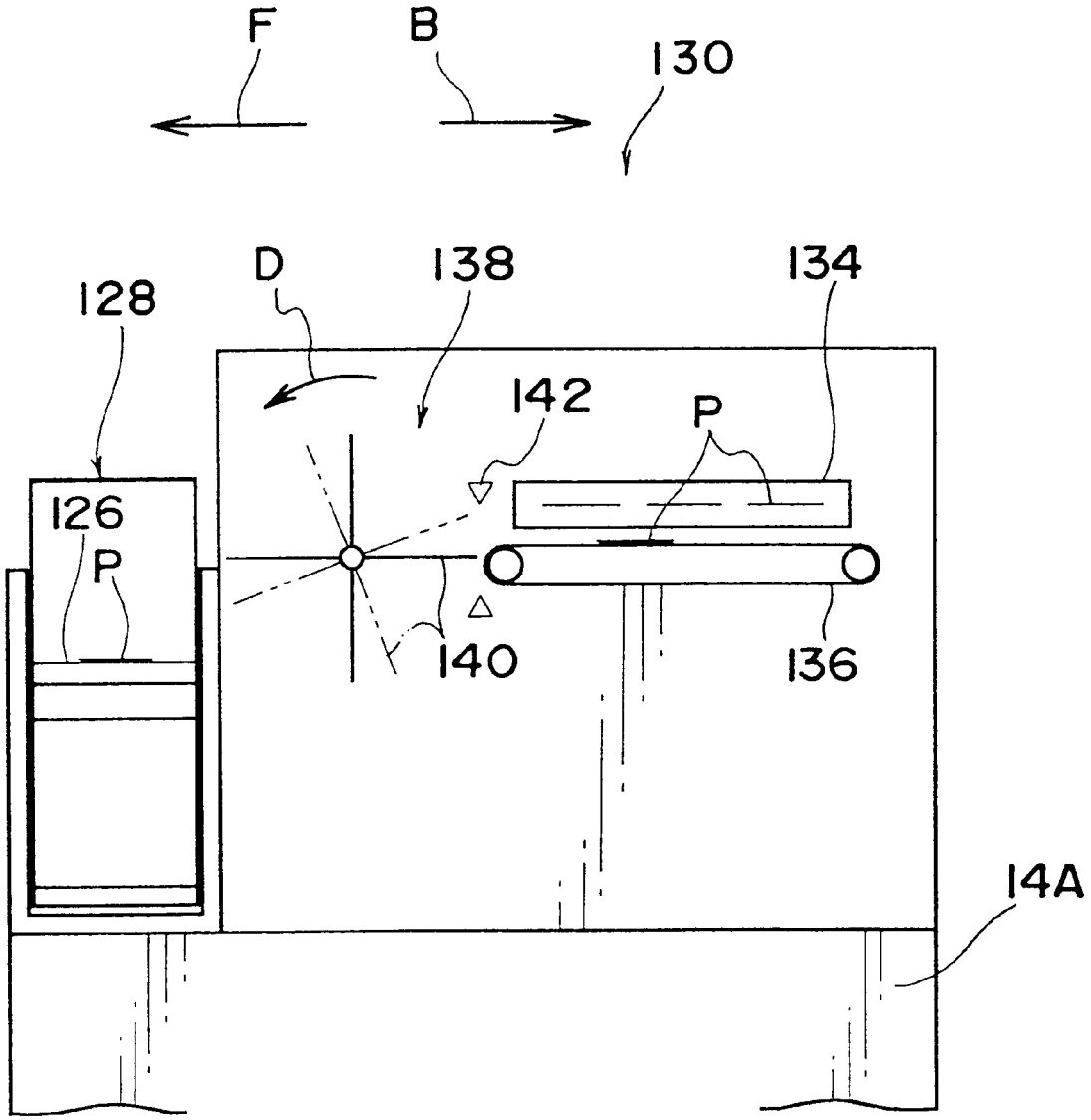
FIG. 19 is a cross-sectional view, as seen from the right side, of main portions of a photosensitive material processing apparatus relating to a seventh embodiment of the present invention.
Figure 20:
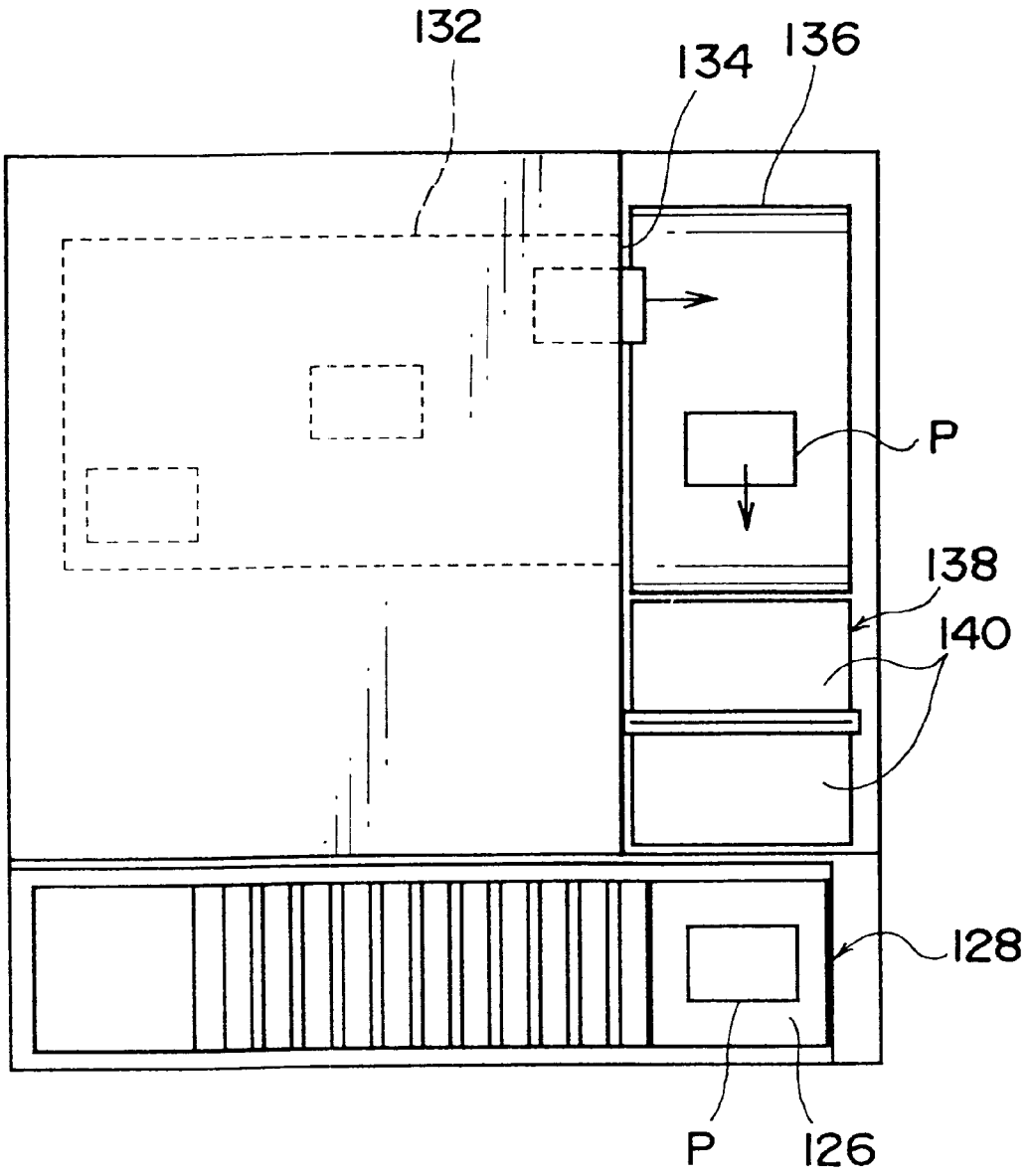
FIG. 20 is a plan view of the main portions illustrated in FIG. 19.

As illustrated in FIGS. 19 and 20, in a printer processor 130 of the present seventh embodiment, a photographic printing paper P is discharged horizontally (in the direction of arrow R) from a discharge opening 134 of a drying portion 132 with the image forming surface facing downward.

A belt conveyor 136, whose conveying direction is orthogonal to the direction in which the photographic printing paper P is discharged, is disposed at the arrow R direction side of the discharge opening 134. A reversing device 138 is provided at the arrow F direction side of the belt conveyor 136.

The reversing device 138 includes four guide plates 140, which are combined in a cross-shaped configuration, and is rotated in the direction of arrow D by a motor (not shown).

A transmitted-light-type light sensor 142 which detects the photographic printing paper P is provided between the reversing device 138 and the belt conveyor 136. The light sensor 142 and the motor which rotates the guide plates 140 are connected to the control device 46, such that the motor is driven on the basis of the detection signal of the light sensor 142.

The sorter 128, which is the same as that of the sixth embodiment, is disposed at the arrow B direction side of the reversing device 138.

The drying portion 132, the belt conveyor 136, the reversing device 138 and the sorter 128 are disposed above the washing portion 14A.

Next, operation of the present seventh embodiment will be described.

The photographic printing paper P, which is discharged from the discharge opening 134 of the drying portion 132 with the image forming surface facing downward, is conveyed in the direction of arrow F by the belt conveyor 136, and is discharged onto the guide plate 140 which is positioned horizontally at the belt conveyor 136 side.

When the light sensor 142 detects that the photographic printing paper P has been discharged onto the guide plate 140, the guide plate 140 is rotated a little more than 180 degrees in the direction of arrow D such that the front and back of the photographic printing paper P are reversed, and the photographic printing paper P is discharged to the tray 126 of the sorter 128.

In the present seventh embodiment as well, because the photographic printing papers P are stacked with the image forming surfaces thereof facing upward, the images of the stacked photographic printing papers P can easily be confirmed.

Eighth Embodiment

An eighth embodiment of the present invention will be described with reference to FIGS. 21 and 22. Structures which are the same as those of the above-described embodiments are denoted by the same reference numerals, and description thereof is omitted.

Figure 21:
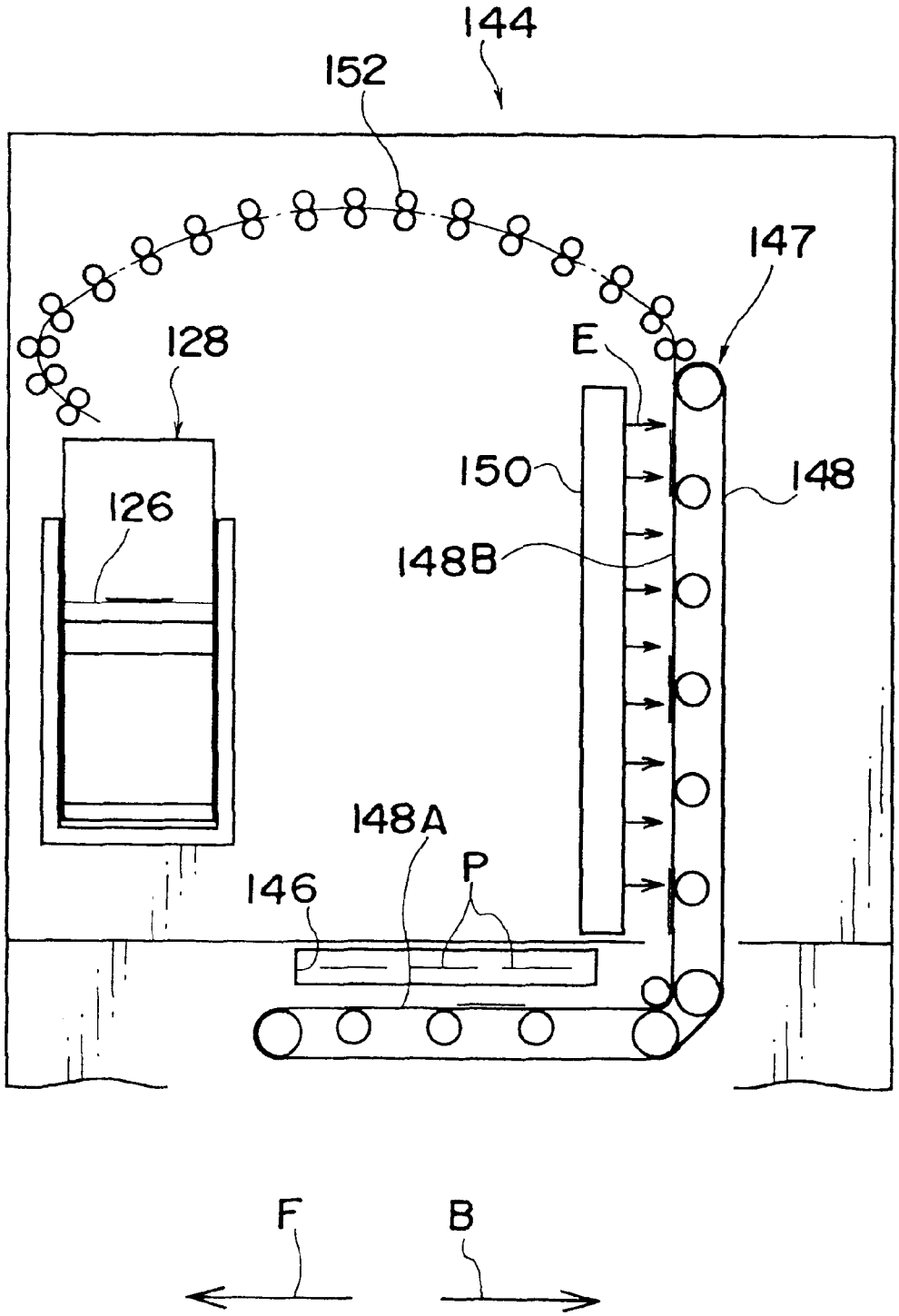
FIG. 21 is a cross-sectional view, as seen from the right side, of main portions of a photosensitive material processing apparatus relating to an eighth embodiment of the present invention.
Figure 22:
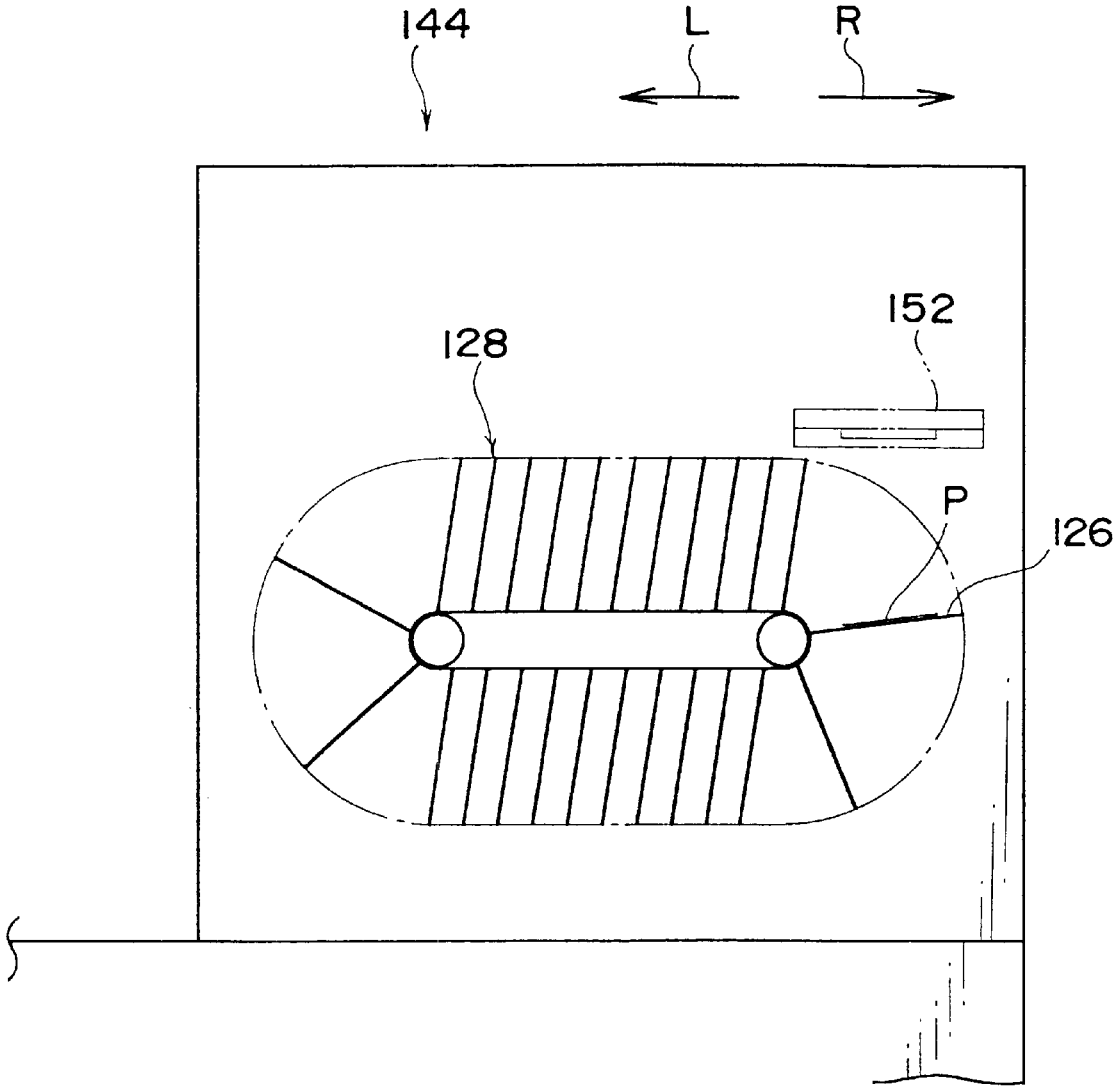
FIG. 22 is a front view of a sorter of the main portions illustrated in FIG. 19.

As illustrated in FIG. 21, in a printer processor 144 of the present eighth embodiment, the photographic printing paper P is discharged, with the image forming surface thereof facing upward, from a discharge opening 146 of a washing portion (not illustrated in FIG. 21) in the horizontal direction (i.e., in the direction of coming forward (out) along the direction perpendicular to the surface of the paper on which FIG. 21 is illustrated).

A belt conveyor 148 of a drying portion 147 is disposed at the photographic printing paper discharge side (the side in the direction of coming forward (out) along the direction perpendicular to the surface of the paper on which FIG. 21 is illustrated) of the discharge opening 146.

The belt conveyor 148 has a horizontal conveying portion 148A and a vertical conveying portion 148B, such that the conveying path is L-shaped.

A nozzle 150, which blows drying air out (in the direction of arrow E) perpendicularly toward the conveying surface of the vertical conveying portion 148B, is disposed at the arrow F direction side of the vertical conveying portion 148B.

A plurality of conveying rollers 152 are disposed above the belt conveyor 148. The conveying rollers 152 convey, in the direction of arrow F, the photographic printing paper P which has been discharged from the upper portion of the vertical conveying portion 148B, and thereafter, make the photographic printing paper P U-turn and discharge the photographic printing paper P in the direction of arrow B.

The sorter 128 which is the same as that of the sixth embodiment is provided at the photographic printing paper discharge side of the conveying rollers 152.

The printer processor 144 of the present eighth embodiment is formed such that the conveying path up to the discharge opening 146 is wide, so that the photographic printing papers P can be processed from developing to drying while being conveyed in plural rows.

Next, operation of the present eighth embodiment will be described.

The photographic printing paper P, which is discharged from the discharge opening 146 of the washing portion with the image forming surface thereof facing upward, is conveyed to the vertical conveying portion 148B by the horizontal conveying portion 148A of the belt conveyor 148.

The drying air from the nozzle 150 is blown out toward the vertical conveying portion 148B. The photographic printing paper P is dried and conveyed upward while being pressed against the conveying surface by the wind pressure of the drying air, with the image forming surface facing toward the nozzle 150 (i.e., in the direction of arrow F).

Thereafter, the photographic printing paper P is conveyed in the direction of arrow F by the plurality of conveying rollers 152 with the image forming surface facing downward. Thereafter, the front and back of the photographic printing paper P are reversed, and the photographic printing paper P is discharged to the tray 126 of the sorter 128 with the image forming surface facing upward.

In the present embodiment, because the photographic printing papers P are stacked with the image forming surfaces thereof facing upward, the images of the stacked photographic printing papers P can easily be confirmed.

Further, because the drying portion 147 and the sorter 128 are disposed at the upper portion of the printer processor 144, the floor surface area taken up by the printer processor 144 can be made small.

What is claimed is:

1. A photosensitive material processing apparatus in which an exposed photosensitive material is conveyed into a developing section with an image forming surface of the photosensitive material facing upward and is discharged from a discharge opening with the image forming surface facing downward, comprising:

an accommodating portion in which the photosensitive material discharged from the discharge opening is stacked; and conveying means, provided between the discharge opening and said accommodating portion, for reversing the front and back of the photosensitive material discharged from the discharge opening, and stacking the photosensitive material in said accommodating portion, wherein said conveying means has a reversing means for reversing a direction of conveyance of the photosensitive material.

2. The photosensitive material processing apparatus of claim 1, wherein a conveying path of said conveying means bends such that a direction of conveyance of the photosensitive material is reversed.

3. A photosensitive material processing apparatus in which an exposed photosensitive material is conveyed into a developing section with an image forming surface of the photosensitive material facing upward and is discharged from a discharge opening with the image forming surface facing downward, comprising:

an accommodating portion in which the photosensitive material discharged from the discharge opening is stacked; and conveying means, provided between the discharge opening and said accommodating portion, for reversing the front and back of the photosensitive material discharged from the discharge opening, and stacking the photosensitive material in said accommodating portion, wherein said conveying means has a reversing means for reversing a direction of conveyance of the photosensitive material, wherein said reversing means is a rotating plate-shaped member on which the photosensitive material is placed.

4. A photosensitive material processing apparatus in which an exposed photosensitive material is conveyed into a developing section with an image forming surface of the photosensitive material facing upward and is discharged from a discharge opening with the image forming surface facing downward, comprising:

an accommodating portion in which the photosensitive material discharged from the discharge opening is stacked; and conveying means, provided between the discharge opening and said accommodating portion, for reversing the front and back of the photosensitive material discharged from the discharge opening, and stacking the photosensitive material in said accommodating portion, wherein said conveying means has a reversing means for reversing a direction of conveyance of the photosensitive material, wherein said reversing means has a pair of belt conveyors which sandwich the photosensitive material.

5. A photosensitive material processing apparatus in which an exposed photosensitive material is conveyed into a developing section with an image forming surface of the photosensitive material facing upward and is discharged from a discharge opening with the image forming surface facing upward, comprising:

an accommodating portion in which the photosensitive material discharged from the discharge opening is stacked; and conveying means, provided between the discharge opening and said accommodating portion, for stacking the photosensitive material, which has been discharged from the discharge opening, in said accommodating portion with the image forming surface facing upward, wherein a conveying path of said conveying means is bent in a substantial Z-shape.

6. A photosensitive material processing apparatus in which an exposed photosensitive material is conveyed into a developing section with an image forming surface of the photosensitive material facing upward and is discharged from a discharge opening with the image forming surface facing upward, comprising:

an accommodating portion in which the photosensitive material discharged from the discharge opening is stacked; and conveying means, provided between the discharge opening and said accommodating portion, for stacking the photosensitive material, which has been discharged from the discharge opening, in said accommodating with the image forming surface facing upward, wherein said conveying means is bent such that the photosensitive material is reversed an even number of times.

* * * * *